US010775082B2

(12) United States Patent
Tanaka et al.

(10) Patent No.: US 10,775,082 B2
(45) Date of Patent: Sep. 15, 2020

(54) REFRIGERATION CYCLE APPARATUS

(71) Applicant: Mitsubishi Electric Corporation, Tokyo (JP)

(72) Inventors: Chitose Tanaka, Tokyo (JP); Takuya Matsuda, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 98 days.

(21) Appl. No.: 16/079,212

(22) PCT Filed: Apr. 7, 2016

(86) PCT No.: PCT/JP2016/061418
§ 371 (c)(1),
(2) Date: Aug. 23, 2018

(87) PCT Pub. No.: WO2017/175359
PCT Pub. Date: Oct. 12, 2017

(65) Prior Publication Data

US 2019/0203989 A1 Jul. 4, 2019

(51) Int. Cl.
*F25B 41/04* (2006.01)
*F25B 49/02* (2006.01)
*F25B 13/00* (2006.01)

(52) U.S. Cl.
CPC ..... *F25B 41/04* (2013.01); *F25B 13/00* (2013.01); *F25B 49/02* (2013.01);
(Continued)

(58) Field of Classification Search
CPC ..... F25B 41/04; F25B 49/02; F25B 13/00; F25B 2600/25; F25B 2600/15;
(Continued)

(56) References Cited

U.S. PATENT DOCUMENTS

2015/0354713 A1* 12/2015 Hancock ..... F16K 11/065 62/77

FOREIGN PATENT DOCUMENTS

CN 104482685 A 4/2015
JP S58-108374 U1 7/1983
(Continued)

OTHER PUBLICATIONS

International Search Report of the International Searching Authority dated Jul. 12, 2016 for the corresponding international application No. PCT/JP2016/061418 (and English translation).
(Continued)

*Primary Examiner* — Steve S Tanenbaum
(74) *Attorney, Agent, or Firm* — Posz Law Group, PLC

(57) ABSTRACT

A refrigerant circuit of a refrigeration cycle apparatus has a compressor, a cooling-heating switching mechanism, a condenser, a refrigerant expansion mechanism, and an evaporator. During operation of the compressor, the refrigerant expansion mechanism opens the refrigerant circuit, a first three-way valve connects an outlet of the compressor to the condenser, and a second three-way valve connects an inlet of the compressor to the evaporator. During stop of the compressor, the refrigerant expansion mechanism closes the refrigerant circuit, the first three-way valve connects the outlet of the compressor to the evaporator, and the second three-way valve connects the inlet of the compressor to the evaporator.

5 Claims, 18 Drawing Sheets

(52) U.S. Cl.
CPC . *F25B 2313/027* (2013.01); *F25B 2313/0292* (2013.01); *F25B 2313/02732* (2013.01); *F25B 2600/15* (2013.01); *F25B 2600/25* (2013.01); *F25B 2600/2513* (2013.01)

(58) Field of Classification Search
CPC ..... F25B 2600/2513; F25B 2313/0292; F25B 2313/02732; F25B 2313/027
USPC ..... 62/324.6
See application file for complete search history.

(56) References Cited

FOREIGN PATENT DOCUMENTS

| | | | |
|---|---|---|---|
| JP | S60-032090 | B | 7/1985 |
| JP | S63-046350 | B | 9/1988 |
| JP | 2004-092802 | A | 3/2004 |
| JP | 4136550 | B | 8/2008 |

OTHER PUBLICATIONS

Extended European Search Report dated Mar. 20, 2019 issued in corresponding EP patent application No. 16897916.9.

* cited by examiner

REFRIGERATION CYCLE APPARATUS

CROSS REFERENCE TO RELATED APPLICATION

This application is a U.S. national stage application of International Application No. PCT/JP2016/061418, filed on Apr. 7, 2016, the contents of which are incorporated herein by reference.

TECHNICAL FIELD

The present invention relates to a refrigeration cycle apparatus.

BACKGROUND

A refrigeration cycle apparatus including a constant-speed compressor performs the start-stop operation (operation of repeating start and stop) when a thermal load is low. When the compressor is stopped, high-temperature and high-pressure liquid refrigerant stored in a condenser flows into an evaporator on the low-temperature and low-pressure side. As a result, the evaporator is heated by and filled with this liquid refrigerant.

At the restart of the refrigeration cycle apparatus, it is necessary to move the liquid refrigerant stored on the evaporator side to the condenser side again by the work of the compressor. Therefore, there are problems of a delay in cooling and heating restart time and an increase in consumed power in the compressor.

Also in the case of a refrigeration cycle apparatus including an inverter compressor whose driving frequency can be controlled, when the frequency of the compressor reaches the lowest frequency for control, the inverter compressor cannot operate with the capacity equal to or lower than the lowest frequency. Therefore, the refrigeration cycle apparatus including the inverter compressor also performs the start-stop operation. Accordingly, similarly to the refrigeration cycle apparatus including the constant-speed compressor, there are problems of a delay in cooling and heating restart time and an increase in consumed power in the compressor.

PTD 1 (Japanese Patent Publication No. 63-46350), for example, discloses an air conditioner in which a state of refrigerant separated into the high-pressure side and the low-pressure side is kept during stop of a compressor, and thus, an energy loss at the restart of the compressor can be reduced and the state can be moved to a steady operation state in a short time. In this air conditioner, an expansion valve is closed during stop of the compressor, and thus, the high-temperature and high-pressure liquid refrigerant is enclosed in a condenser between a check valve placed in a compressor discharge pipe and the closed expansion valve.

PATENT LITERATURE

PTD 1: Japanese Patent Publication No. 63-46350

However, the air conditioner described in the above-referenced patent document includes the check valve placed in the compressor discharge pipe, and thus, has a problem of a pressure loss during normal operation caused by the check valve.

SUMMARY

The present invention has been made in light of the above-described problem, and an object of the present invention is to provide a refrigeration cycle apparatus in which the cooling and heating restart time can be reduced, the consumed power in a compressor can be reduced and a pressure loss during normal operation can be suppressed.

A refrigeration cycle apparatus of the present invention includes: a refrigerant circuit; and refrigerant. The refrigerant circuit has a compressor, a cooling-heating switching mechanism, a condenser, a refrigerant expansion mechanism, and an evaporator. The refrigerant circulates through the refrigerant circuit in order of the compressor, the cooling-heating switching mechanism, the condenser, the refrigerant expansion mechanism, the evaporator, and the cooling-heating switching mechanism. The compressor has an inlet and an outlet, and is configured to compress the refrigerant introduced from the inlet and discharge the refrigerant from the outlet. The refrigerant expansion mechanism is configured to open and close the refrigerant circuit. The cooling-heating switching mechanism has a first three-way valve configured to switch to connect the outlet of the compressor to one of the condenser and the evaporator, and a second three-way valve configured to switch to connect the inlet of the compressor to one of the condenser and the evaporator. During operation of the compressor, the refrigerant expansion mechanism opens the refrigerant circuit, the first three-way valve connects the outlet of the compressor to the condenser, and the second three-way valve connects the inlet of the compressor to the evaporator. During stop of the compressor, the refrigerant expansion mechanism closes the refrigerant circuit, the first three-way valve connects the outlet of the compressor to the evaporator, and the second three-way valve connects the inlet of the compressor to the evaporator.

According to the refrigeration cycle apparatus of the present invention, the refrigerant expansion mechanism closes the refrigerant circuit during stop of the compressor, and thus, it is possible to prevent the high-temperature and high-pressure liquid refrigerant in the condenser from flowing into the evaporator. The first three-way valve connects the outlet of the compressor to the evaporator, and the second three-way valve connects the inlet of the compressor to the evaporator. Therefore, it is possible to prevent the high-temperature and high-pressure liquid refrigerant and the refrigerant gas in the condenser from flowing into the compressor. Therefore, the high-temperature and high-pressure liquid refrigerant in the condenser can be stored between the refrigerant expansion mechanism and the cooling-heating switching mechanism with the condenser being interposed. Therefore, it is unnecessary to move the liquid refrigerant flowing from the condenser into the evaporator and the compressor during stop of the compressor, from the evaporator and the compressor to the condenser at the restart of the compressor. Therefore, the cooling and heating restart time can be reduced and the consumed power in the compressor can be reduced. In addition, the first three-way valve and the second three-way valve can prevent the liquid refrigerant from flowing from the condenser into the compressor, and thus, a pressure loss during normal operation can be suppressed.

DETAILED DESCRIPTION

Embodiments of the present invention will be described hereinafter with reference to the drawings.

First Embodiment

Figure 1:
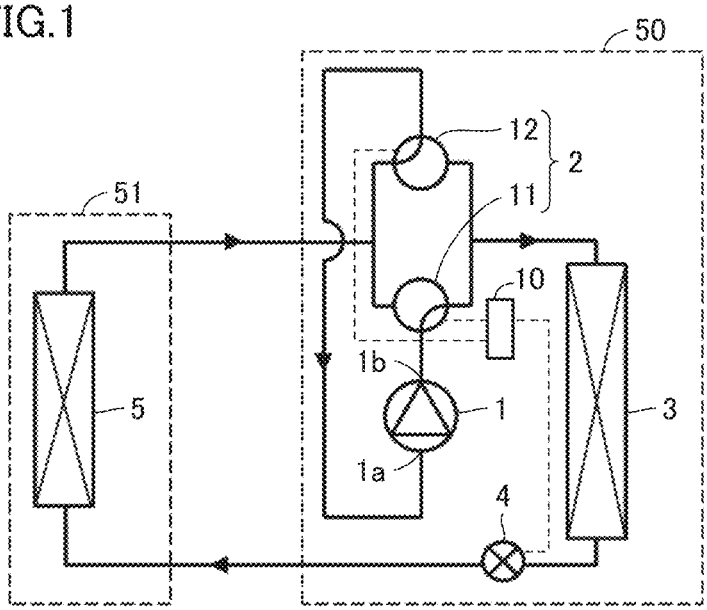
FIG. 1 is a refrigerant circuit diagram of a refrigeration cycle apparatus in a first embodiment of the present invention.

FIG. 1 is a refrigerant circuit diagram of a refrigeration cycle apparatus in a first embodiment of the present invention. A configuration of the refrigeration cycle apparatus in the first embodiment of the present invention will be described with reference to FIG. 1.

The refrigeration cycle apparatus in the first embodiment of the present invention includes a refrigerant circuit having a compressor 1, a cooling-heating switching mechanism 2, an outdoor heat exchanger 3, a refrigerant expansion mechanism 4, and an indoor heat exchanger 5. The refrigeration cycle apparatus in the first embodiment of the present invention also includes a controller 10. Compressor 1, cooling-heating switching mechanism 2, outdoor heat exchanger 3, refrigerant expansion mechanism 4, and indoor heat exchanger 5 communicate with one another by a pipe to thereby form the refrigerant circuit. Compressor 1, cooling-heating switching mechanism 2, outdoor heat exchanger 3, and refrigerant expansion mechanism 4 are housed in an outdoor unit 50. Indoor heat exchanger 5 is housed in an indoor unit 51.

The refrigeration cycle apparatus in the first embodiment of the present invention also includes refrigerant circulating through the refrigerant circuit. R410a, R32, R1234yf and the like can, for example, be used as the refrigerant.

During cooling operation, the refrigerant circulates through the refrigerant circuit in order of compressor 1, cooling-heating switching mechanism 2, outdoor heat exchanger (condenser) 3, refrigerant expansion mechanism 4, indoor heat exchanger (evaporator) 5, and cooling-heating switching mechanism 2. That is, the refrigerant circuit is configured such that the refrigerant having flown through compressor 1, cooling-heating switching mechanism 2, outdoor heat exchanger (condenser) 3, refrigerant expansion mechanism 4, and indoor heat exchanger (evaporator) 5 in this order passes through cooling-heating switching mechanism 2 again and reaches compressor 1.

On the other hand, during heating operation, the refrigerant circulates through the refrigerant circuit in order of compressor 1, cooling-heating switching mechanism 2, indoor heat exchanger (condenser) 5, refrigerant expansion mechanism 4, outdoor heat exchanger (evaporator) 3, and cooling-heating switching mechanism 2. That is, the refrigerant circuit is configured such that the refrigerant having flown through compressor 1, cooling-heating switching mechanism 2, indoor heat exchanger (condenser) 5, refrigerant expansion mechanism 4, and outdoor heat exchanger (evaporator) 3 in this order passes through cooling-heating switching mechanism 2 again and reaches compressor 1.

Compressor 1 is configured to compress the refrigerant. Compressor 1 has an inlet 1*a* and an outlet 1*b*. Compressor 1 is configured to compress the refrigerant introduced from inlet 1*a* and discharge the refrigerant from outlet 1*b*. Compressor 1 may be a constant-speed compressor having a constant compression capacity, or may be an inverter compressor having a variable compression capacity. The inverter compressor is configured such that the number of rotations can be variably controlled. Specifically, the driving frequency of the inverter compressor is changed based on a command from controller 10 and the number of rotations is thereby adjusted. As a result, the compression capacity varies. The compression capacity refers to an amount of refrigerant delivered per unit time.

Cooling-heating switching mechanism 2 is configured to switch a flow of the refrigerant between during cooling operation and during heating operation. Cooling-heating switching mechanism 2 includes a first three-way valve 11 and a second three-way valve 12. First three-way valve 11 and second three-way valve 12 are configured to be switchable independently from each other. First three-way valve 11 and second three-way valve 12 are connected to each other by a pipe.

First three-way valve 11 is configured to switch to connect outlet 1*b* of compressor 1 to one of outdoor heat exchanger (cooling operation: condenser, heating operation: evaporator) 3 and indoor heat exchanger (cooling operation: evaporator, heating operation: condenser) 5. First three-way valve 11 is connected to outlet 1*b* of compressor 1 by a pipe (compressor discharge pipe). First three-way valve 11 is connected to each of outdoor heat exchanger 3 and indoor heat exchanger 5 by a pipe.

Second three-way valve 12 is configured to switch to connect inlet 1*a* of compressor 1 to one of outdoor heat exchanger (cooling operation: condenser, heating operation: evaporator) 3 and indoor heat exchanger (cooling operation: evaporator, heating operation: condenser) 5. Second three-way valve 12 is connected to inlet 1*a* of compressor 1 by a pipe (compressor suction pipe). Second three-way valve 12 is connected to each of outdoor heat exchanger 3 and indoor heat exchanger 5 by a pipe.

During operation of compressor 1, first three-way valve 11 is configured to connect outlet 1*b* of compressor 1 to the condenser (cooling operation: outdoor heat exchanger 3, heating operation: indoor heat exchanger 5), and second three-way valve 12 is configured to connect inlet 1*a* of compressor 1 to the evaporator (cooling operation: indoor heat exchanger 5, heating operation: outdoor heat exchanger 3). During stop of compressor 1, first three-way valve 11 is configured to connect outlet 1*b* of compressor 1 to the evaporator (cooling operation: indoor heat exchanger 5, heating operation: outdoor heat exchanger 3), and second three-way valve 12 is configured to connect inlet 1*a* of compressor 1 to the evaporator (cooling operation: indoor heat exchanger 5, heating operation: outdoor heat exchanger 3).

Outdoor heat exchanger 3 is for performing heat exchange between the refrigerant and the air (outdoor air). Outdoor heat exchanger 3 is formed, for example, by a pipe and a fin. During cooling operation, outdoor heat exchanger 3 functions as a condenser, and performs heat exchange between the air and the refrigerant introduced via cooling-heating switching mechanism 2 and compressed by compressor 1, to thereby condense and liquefy the refrigerant. That is, during cooling operation, outdoor heat exchanger (condenser) 3 is configured to condense the refrigerant compressed by compressor 1.

On the other hand, during heating operation, outdoor heat exchanger 3 functions as an evaporator, and performs heat exchange between the air and the low-pressure refrigerant introduced via refrigerant expansion mechanism 4, to thereby evaporate and vaporize the refrigerant. That is, during heating operation, outdoor heat exchanger (evaporator) 3 is configured to evaporate the refrigerant expanded (decompressed) by refrigerant expansion mechanism 4.

Refrigerant expansion mechanism 4 is configured to expand (decompress) the refrigerant condensed by the condenser (cooling operation: outdoor heat exchanger 3, heating operation: indoor heat exchanger 5). Refrigerant expansion mechanism 4 is configured to open and close the refrigerant circuit. Refrigerant expansion mechanism 4 is configured to open the refrigerant circuit during operation of compressor 1 and close the refrigerant circuit during stop of compressor 1. Refrigerant expansion mechanism 4 includes, for example, an electronic expansion valve. In this case, refrigerant expansion mechanism 4 is configured to be capable of adjusting a flow rate of the refrigerant flowing through refrigerant expansion mechanism 4, by adjusting the degree of opening of the electronic expansion valve. The flow rate of the refrigerant flowing through refrigerant expansion mechanism 4 refers to a flow rate per unit time.

Indoor heat exchanger 5 is for performing heat exchange between the refrigerant and the air (indoor air). Indoor heat exchanger 5 is formed, for example, by a pipe and a fin. During cooling operation, indoor heat exchanger 5 functions as an evaporator, and performs heat exchange between the air and the refrigerant brought into the low-pressure state by refrigerant expansion mechanism 4, and causes the refrigerant to take away the heat of the air, to thereby evaporate and vaporize the refrigerant. That is, indoor heat exchanger (evaporator) 5 is configured to evaporate the refrigerant expanded (decompressed) by refrigerant expansion mechanism 4.

On the other hand, during heating operation, indoor heat exchanger 5 functions as a condenser, and performs heat exchange between the air and the refrigerant introduced via cooling-heating switching mechanism 2 and compressed by compressor 1, to thereby condense and liquefy the refrigerant. That is, during heating operation, indoor heat exchanger (condenser) 5 is configured to condense the refrigerant compressed by compressor 1.

Controller 10 is configured to control the means, the devices and the like of the refrigeration apparatus by, for example, performing a computation and providing a command Particularly, controller 10 is configured to control the operation of cooling-heating switching mechanism 2 and refrigerant expansion mechanism 4. Specifically, controller 10 is electrically connected to each of first and second three-way valves 11 and 12 and refrigerant expansion mechanism 4, and is configured to control the operation of these components.

One example of each of first three-way valve 11 and second three-way valve 12 will be described with reference to FIGS. 2 and 3.

As shown in FIG. 2(A), first three-way valve 11 includes a first main body C1, a first flow path F1 and a first valve body V1. First main body C1 has first flow path F1 therein. First flow path F1 has a first connection port P1, and second and third connection ports P2 and P3 arranged so as to sandwich first connection port P1.

First connection port P1 is connected to outlet 1*b* of compressor 1 shown in FIG. 1. During cooling operation, second connection port P2 is connected to outdoor heat exchanger (condenser) 3 shown in FIG. 1, and third connection port P3 is connected to indoor heat exchanger (evaporator) 5 shown in FIG. 1. On the other hand, during heating operation, second connection port P2 is connected to indoor heat exchanger (condenser) 5 shown in FIG. 1, and third connection port P3 is connected to outdoor heat exchanger (evaporator) 3 shown in FIG. 1.

As shown in FIGS. 2(A) and 2(B), first valve body V1 is arranged in first flow path F1. First valve body V1 is configured to switch to connect first connection port P1 to one of second connection port P2 and third connection port P3. First valve body V1 is configured to be rotatable about an axial direction A of first valve body V1. First valve body V1 is, for example, an electrically-driven valve, and is configured such that driving thereof is controlled by a not-shown motor based on a command from controller 10.

As shown in FIG. 3(A), second three-way valve 12 includes a second main body C2, a second flow path F2 and a second valve body V2. Second main body C2 has second flow path F2 therein. Second flow path F2 has a fourth connection port P4, and fifth and sixth connection ports P5 and P6 arranged so as to sandwich fourth connection port P4.

Fourth connection port P4 is connected to inlet 1*a* of compressor 1 shown in FIG. 1. During cooling operation, fifth connection port P5 is connected to indoor heat exchanger (evaporator) 5 shown in FIG. 1. Sixth connection port P6 is connected to outdoor heat exchanger (condenser) 3 shown in FIG. 1. On the other hand, during heating operation, fifth connection port P5 is connected to outdoor heat exchanger (evaporator) 3 shown in FIG. 1. Sixth connection port P6 is connected to indoor heat exchanger (condenser) 5 shown in FIG. 1.

As shown in FIGS. 3(A) and 3(B), second valve body V2 is arranged in second flow path F2. Second valve body V2 is configured to switch to connect fourth connection port P4 to one of fifth connection port P5 and sixth connection port P6. Second valve body V2 is configured to be rotatable about axial direction A of second valve body V2. Second valve body V2 is, for example, an electrically-driven valve, and is configured such that driving thereof is controlled by a not-shown motor based on a command from controller 10.

Next, another example of each of first three-way valve 11 and second three-way valve 12 will be described with reference to FIGS. 4 and 5.

As shown in FIG. 4(A), first three-way valve 11 includes first main body C1, first flow path F1, first valve body V1, a first valve seat VS1, a second valve seat VS2, a rod RD, a movable body MB, a coil CO, and a spring SP. First main body C1 has first flow path F1 therein. First flow path F1 has first connection port P1, and second and third connection ports P2 and P3 arranged so as to sandwich first connection port P1.

First connection port P1 is connected to outlet 1*b* of compressor 1 shown in FIG. 1. During cooling operation, second connection port P2 is connected to outdoor heat exchanger (condenser) 3 shown in FIG. 1, and third connection port P3 is connected to indoor heat exchanger (evaporator) 5 shown in FIG. 1. On the other hand, during heating operation, second connection port P2 is connected to indoor heat exchanger (condenser) 5 shown in FIG. 1, and third connection port P3 is connected to outdoor heat exchanger (evaporator) 3 shown in FIG. 1.

First valve seat VS1 and second valve seat VS2 are arranged in first flow path F1. First valve seat VS1 is arranged between first connection port P1 and second connection port P2. Second valve seat VS2 is arranged between first connection port P1 and third connection port P3.

First valve body V1 is connected to movable body MB by rod RD. Coil CO is arranged so as to surround movable body MB. On the opposite side of rod RD, movable body MB is connected to spring SP. Spring SP is attached to each of movable body MB and first main body C1.

As shown in FIGS. 4(A) and 4(B), first valve body V1 is arranged in first flow path F1. First valve body V1 is configured to switch to connect first connection port P1 to one of second connection port P2 and third connection port P3. Movable body MB is configured to be movable in an axial direction of rod RD due to a magnetic flux generated as a result of energization of coil CO based on a command from controller 10. Movable body MB is also configured to be movable in the axial direction of rod RD due to the elastic force of spring SP.

Therefore, first valve body V1 is configured to be movable in the axial direction of rod RD with the movement of movable body MB. When first valve body V1 comes into contact with second valve seat VS2, connection between first connection port P1 and third connection port P3 is interrupted, and first connection port P1 is connected to second connection port P2. On the other hand, when first valve body V1 comes into contact with first valve seat VS1, connection between first connection port P1 and second connection port P2 is interrupted, and first connection port P1 is connected to third connection port P3.

As shown in FIG. 5(A), second three-way valve 12 includes second main body C2, second flow path F2, second valve body V2, first valve seat VS1, second valve seat VS2, rod RD, movable body MB, coil CO, and spring SP. Second main body C2 has second flow path F2 therein. Second flow path F2 has fourth connection port P4, and fifth and sixth connection ports P5 and P6 arranged so as to sandwich fourth connection port P4.

Fourth connection port P4 is connected to inlet 1*a* of compressor 1 shown in FIG. 1. During cooling operation, fifth connection port P5 is connected to indoor heat exchanger (evaporator) 5 shown in FIG. 1. Sixth connection port P6 is connected to outdoor heat exchanger (condenser) 3 shown in FIG. 1. On the other hand, during heating operation, fifth connection port P5 is connected to outdoor heat exchanger (evaporator) 3 shown in FIG. 1. Sixth connection port P6 is connected to indoor heat exchanger (condenser) 5 shown in FIG. 1.

First valve seat VS1 and second valve seat VS2 are arranged in second flow path F2. First valve seat VS1 is arranged between fourth connection port P4 and fifth connection port P5. Second valve seat VS2 is arranged between fourth connection port P4 and sixth connection port P6.

Second valve body V2 is connected to movable body MB by rod RD. Coil CO is arranged so as to surround movable body MB. On the opposite side of rod RD, movable body MB is connected to spring SP. Spring SP is attached to each of movable body MB and second main body C2.

As shown in FIGS. 5(A) and 5(B), second valve body V2 is arranged in second flow path F2. Second valve body V2 is configured to switch to connect fourth connection port P4 to one of fifth connection port P5 and sixth connection port P6. Movable body MB is configured to be movable in an axial direction of rod RD due to a magnetic flux generated as a result of energization of coil CO based on a command from controller 10. Movable body MB is also configured to be movable in the axial direction of rod RD due to the elastic force of spring SP.

Therefore, second valve body V2 is configured to be movable in the axial direction of rod RD with the movement of movable body MB. When second valve body V2 comes into contact with second valve seat VS2, connection between fourth connection port P4 and sixth connection port P6 is interrupted, and fourth connection port P4 is connected to fifth connection port P5. On the other hand, when second valve body V2 comes into contact with first valve seat VS1, connection between fourth connection port P4 and fifth connection port P5 is interrupted, and fourth connection port P4 is connected to sixth connection port P6.

Next, the operation of the refrigeration cycle apparatus in the present embodiment will be described.

The operation during cooling operation will be described with reference again to FIG. 1. During cooling operation, first three-way valve 11 is switched to the outdoor heat exchanger (condenser) 3 side, and second three-way valve 12 is switched to the indoor heat exchanger (evaporator) 5 side.

Specifically, during operation of compressor 1, first three-way valve 11 connects outlet 1*b* of compressor 1 to outdoor heat exchanger (condenser) 3, and second three-way valve 12 connects inlet 1*a* of compressor 1 to indoor heat exchanger (evaporator) 5. Furthermore, refrigerant expansion mechanism 4 is opened. That is, refrigerant expansion mechanism 4 operates so as to open the refrigerant circuit.

The refrigerant flows through compressor 1 and first three-way valve 11, is condensed in outdoor heat exchanger (condenser) 3, is expanded in refrigerant expansion mechanism 4 to come into a low-pressure two-phase state, is evaporated in indoor heat exchanger (evaporator) 5, and flows through second three-way valve 12 to compressor 1 again. In this way, the refrigerant circulates through the refrigeration cycle apparatus.

Figure 6:
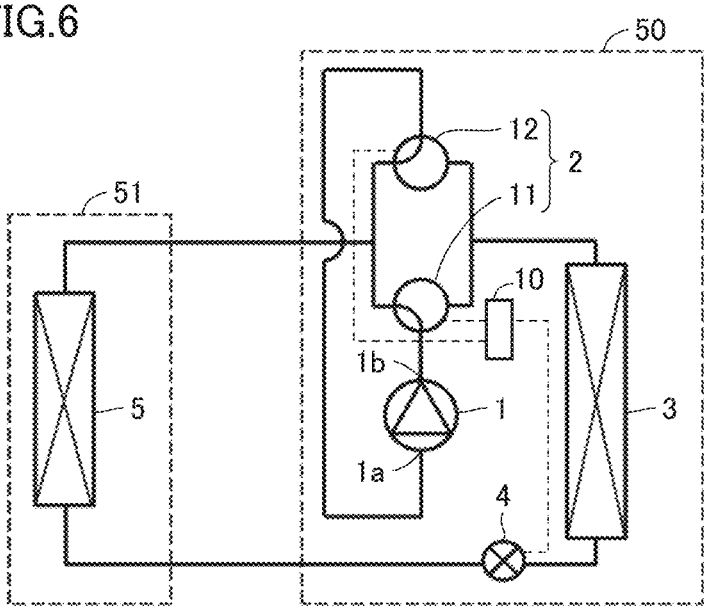
FIG. 6 is a refrigerant circuit diagram during stop of cooling in the first embodiment of the present invention.

Next, the operation during stop of cooling will be described with reference to FIG. 6. During stop of cooling, first three-way valve 11 is switched to the indoor heat exchanger (evaporator) 5 side, and at the same time, refrigerant expansion mechanism 4 is closed. Second three-way valve 12 remains switched to the indoor heat exchanger (evaporator) 5 side which is the same as during cooling operation.

Specifically, during stop of compressor 1, first three-way valve 11 connects outlet 1*b* of compressor 1 to indoor heat exchanger (evaporator) 5, and second three-way valve 12 connects inlet 1*a* of compressor 1 to indoor heat exchanger (evaporator) 5. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with outdoor heat exchanger (condenser) 3 being interposed. As a result, the high-temperature and high-pressure liquid refrigerant in outdoor heat exchanger (condenser) 3 is stored between refrigerant expansion mechanism 4 and cooling-heating switching mechanism 2.

Figure 7:
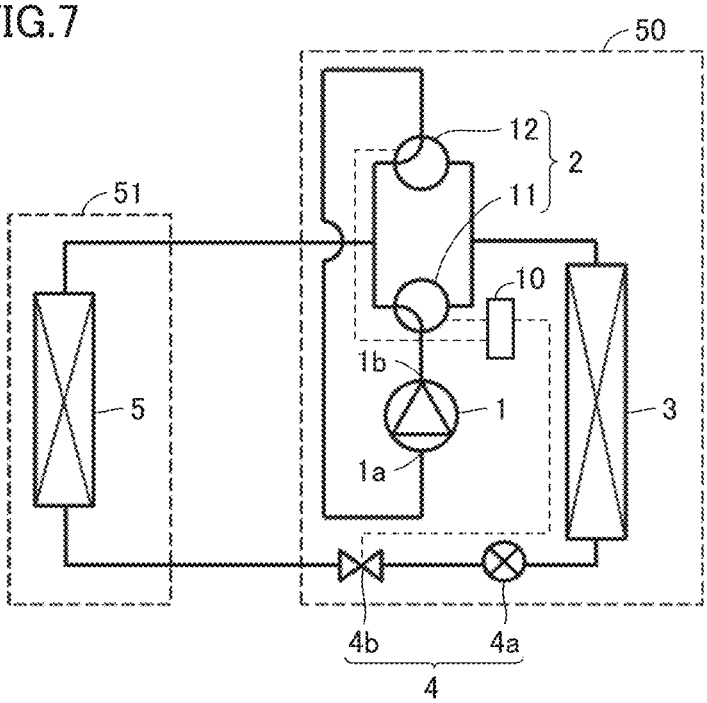
FIG. 7 is a refrigerant circuit diagram of a modification of a refrigerant expansion mechanism during stop of cooling in the first embodiment of the present invention.

Next, a modification of refrigerant expansion mechanism 4 during stop of cooling will be described with reference to FIG. 7.

In the case of using the electronic expansion valve as refrigerant expansion mechanism 4, refrigerant leakage may occur when the electronic expansion valve is fully closed and it may take time to reach the fully closed state (generally, about 15 seconds). In addition, a capillary tube that does not have a closing mechanism may in some cases be used as refrigerant expansion mechanism 4. In these cases, a shutoff valve may be provided so as to be closed during stop of the compressor.

In the modification of refrigerant expansion mechanism 4, refrigerant expansion mechanism 4 includes a throttle device 4*a* and a shutoff valve 4*b*. Shutoff valve 4*b* is connected between throttle device 4*a* and outdoor heat exchanger (condenser or evaporator) 3 or between throttle device 4*a* and indoor heat exchanger (evaporator or condenser) 5. Specifically, shutoff valve 4*b* is provided directly before or directly after throttle device 4*a*.

Next, the operation during heating operation will be described with reference to FIG. 8. During heating operation, first three-way valve 11 is switched to the indoor heat exchanger (condenser) 5 side, and second three-way valve 12 is switched to the outdoor heat exchanger (evaporator) 3 side.

Specifically, during operation of compressor 1, first three-way valve 11 connects outlet 1*b* of compressor 1 to indoor heat exchanger (condenser) 5, and second three-way valve 12 connects inlet 1*a* of compressor 1 to outdoor heat exchanger (evaporator) 3. Furthermore, refrigerant expansion mechanism 4 is opened. That is, refrigerant expansion mechanism 4 operates so as to open the refrigerant circuit.

The refrigerant flows through compressor 1 and first three-way valve 11, is condensed in indoor heat exchanger (condenser) 5, is expanded in refrigerant expansion mechanism 4 to come into a low-pressure two-phase state, is evaporated in outdoor heat exchanger (evaporator) 3, and flows through second three-way valve 12 to compressor 1 again. In this way, the refrigerant circulates through the refrigeration cycle apparatus.

Figure 9:
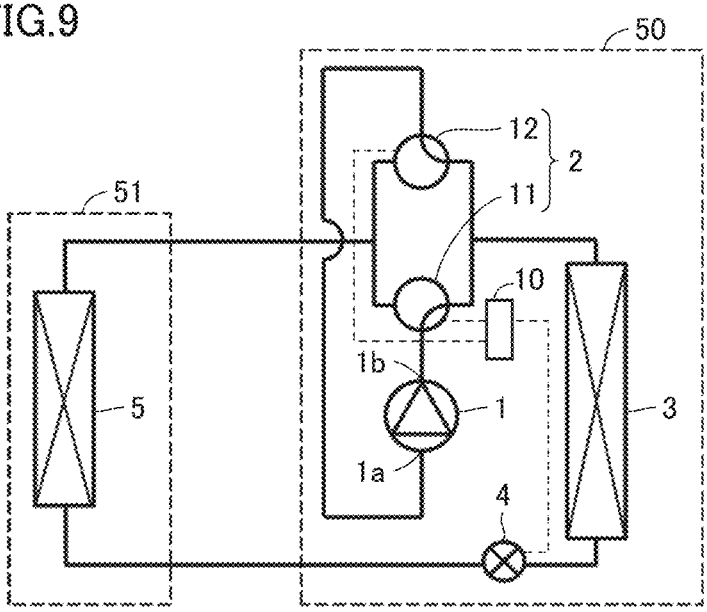
FIG. 9 is a refrigerant circuit diagram during stop of heating in the first embodiment of the present invention.

Next, the operation during stop of heating will be described with reference to FIG. 9. During stop of heating, first three-way valve 11 is switched to the outdoor heat exchanger (evaporator) 3 side, and at the same time, refrigerant expansion mechanism 4 is closed. Second three-way valve 12 remains switched to the outdoor heat exchanger (evaporator) 3 side which is the same as during heating operation.

Specifically, during stop of compressor 1, first three-way valve 11 connects outlet 1*b* of compressor 1 to outdoor heat exchanger (evaporator) 3, and second three-way valve 12 connects inlet 1*a* of compressor 1 to outdoor heat exchanger (evaporator) 5. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with indoor heat exchanger (condenser) 5 being interposed. As a result, the high-temperature and high-pressure liquid refrigerant in indoor heat exchanger (condenser) 5 is stored between refrigerant expansion mechanism 4 and cooling-heating switching mechanism 2.

Figure 10:
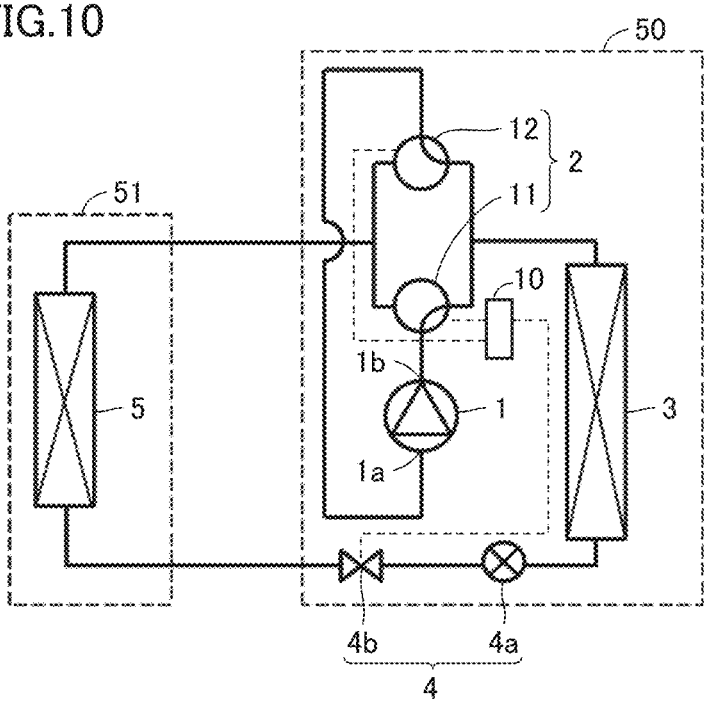
FIG. 10 is a refrigerant circuit diagram of the modification of the refrigerant expansion mechanism during stop of heating in the first embodiment of the present invention.

Next, a modification of refrigerant expansion mechanism 4 during stop of heating will be described with reference to FIG. 10. Similarly to during stop of cooling, in the case of using the electronic expansion valve as refrigerant expansion mechanism 4, refrigerant leakage may also occur when the electronic expansion valve is fully closed and it may also take time to reach the fully closed state (generally, about 15 seconds) during stop of heating. In addition, a capillary tube that does not have a closing mechanism may in some cases be used as refrigerant expansion mechanism 4. In these cases, a shutoff valve may be provided so as to be closed during stop of the compressor.

Therefore, in the modification of refrigerant expansion mechanism 4 during stop of heating as well, refrigerant expansion mechanism 4 includes throttle device 4*a* and shutoff valve 4*b*. Shutoff valve 4*b* is connected between throttle device 4*a* and outdoor heat exchanger (condenser or evaporator) 3 or between throttle device 4*a* and indoor heat exchanger (evaporator or condenser) 5. Specifically, shutoff valve 4*b* is provided directly before or directly after throttle device 4*a*.

Next, the function and effect of the refrigeration cycle apparatus in the present embodiment will be described in comparison with Comparative Examples 1 to 4.

Figure 11:
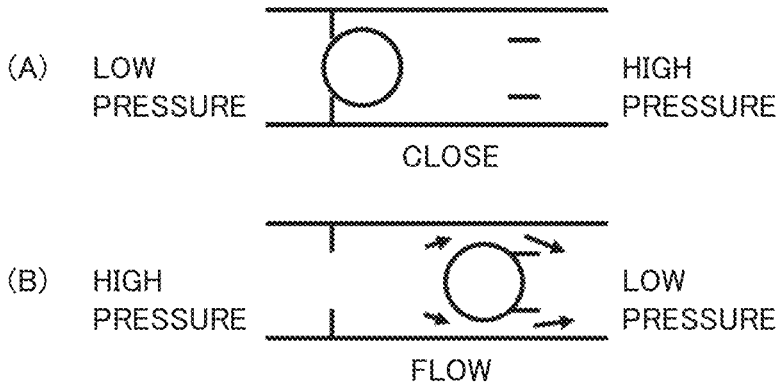
FIG. 11 is a cross-sectional view schematically showing a configuration of a small-sized check valve in Comparative Example 1.

The case of using a small-sized check valve in a compressor discharge pipe will be described as Comparative Example 1 with reference to FIG. 11. FIG. 11(A) shows a state in which the check valve is closed, and FIG. 11(B) shows a state in which the check valve is open. This small-sized check valve has a problem of production of a pressure loss during normal operation.

Figure 12:
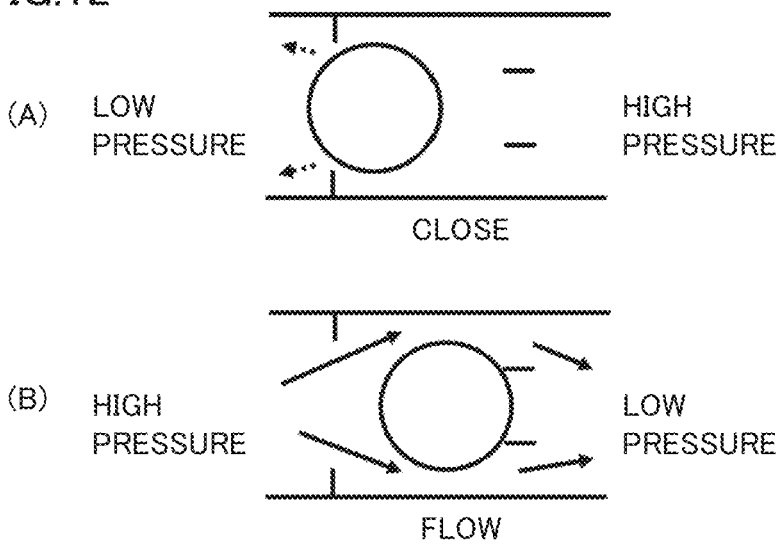
FIG. 12 is a cross-sectional view schematically showing a configuration of a large-sized check valve in Comparative Example 2.

The case of using a large-sized check valve in a compressor discharge pipe will be described as Comparative Example 2 with reference to FIG. 12. FIG. 12(A) shows a state in which the check valve is closed, and FIG. 12(B) shows a state in which the check valve is open. In addition to the problem of a pressure loss during normal operation produced by the check valve, this large-sized check valve has problems of high cost and an increase in amount of refrigerant leakage when the check valve is closed.

Figure 13:
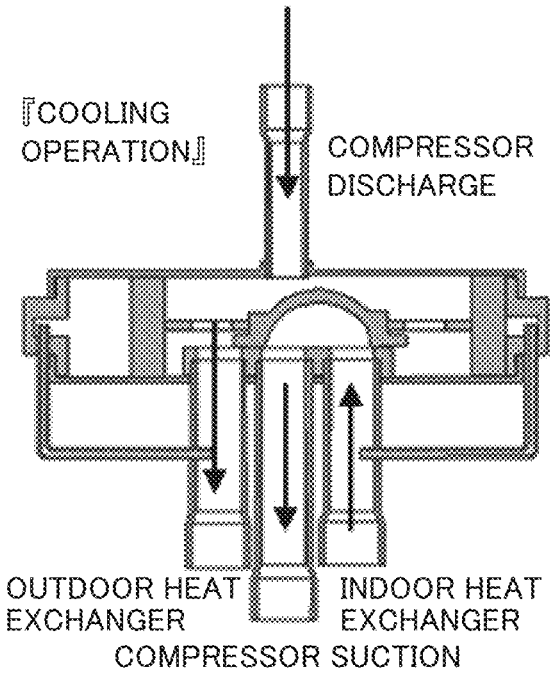
FIG. 13 is a cross-sectional view schematically showing a configuration of a sliding four-way valve and a flow of refrigerant during cooling operation in Comparative Example 3.
Figure 14:
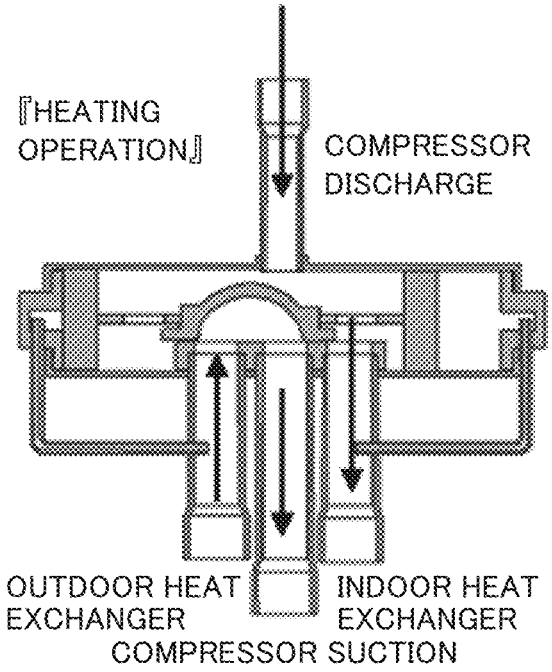
FIG. 14 is a cross-sectional view schematically showing a configuration of the sliding four-way valve and a flow of the refrigerant during heating operation in Comparative Example 3.
Figure 15:
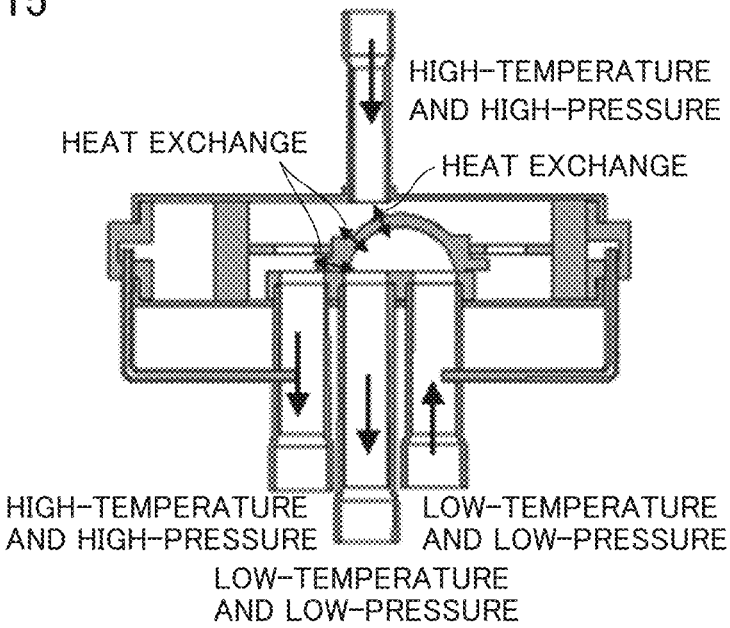
FIG. 15 is a cross-sectional view schematically showing heat exchange in the sliding four-way valve in Comparative Example 3.
Figure 16:
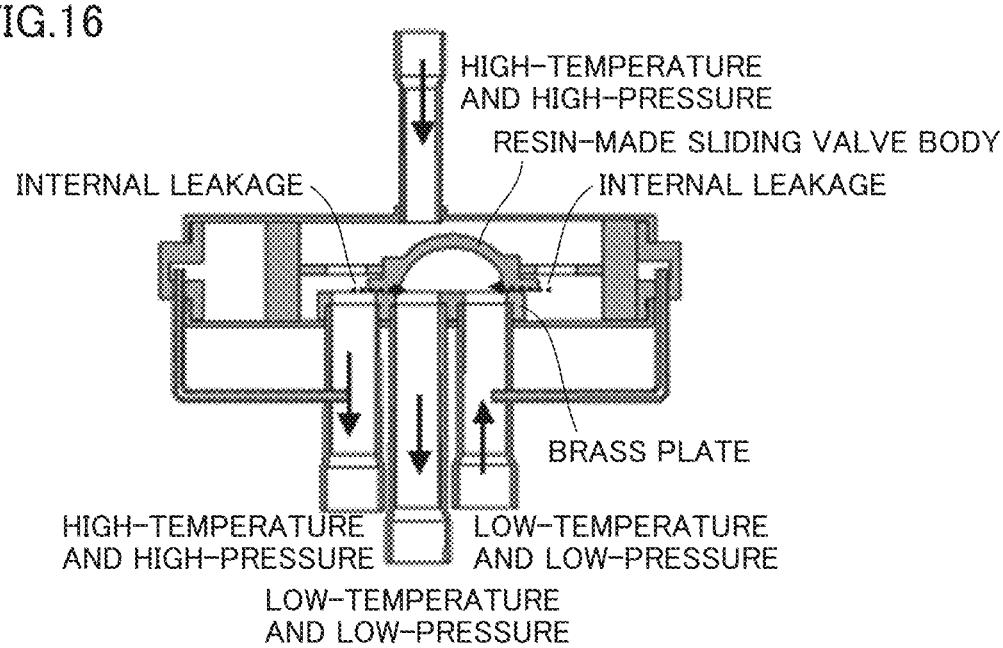
FIG. 16 is a cross-sectional view schematically showing refrigerant leakage in the sliding four-way valve in Comparative Example 3.

The case of using a sliding four-way valve in a cooling-heating switching mechanism will be described as Comparative Example 3 with reference to FIGS. 13 to 16. FIG. 13 shows a flow of refrigerant during cooling operation. FIG. 14 shows a flow of the refrigerant during heating operation. As shown in FIG. 15, in the case of the sliding four-way valve, the high-temperature and high-pressure refrigerant discharged from a compressor and the low-temperature and low-pressure refrigerant introduced into the compressor flow in proximity to each other. Therefore, there is a problem of a cooling and heating capacity loss caused by heat exchange between the fluids in the four-way valve. In addition, as shown in FIG. 16, the internal airtightness of the sliding four-way valve relies on pressing of a resin-made sliding valve body against a brass plate caused by a high-low pressure difference. Therefore, there is a problem of a reduction in cooling and heating capacity caused by leakage of the refrigerant from the high pressure side to the low pressure side.

Figure 17:
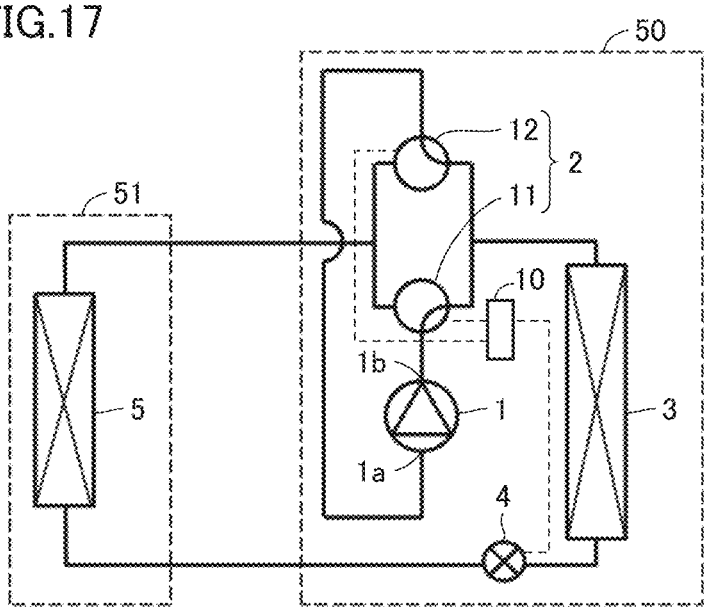
FIG. 17 is a refrigerant circuit diagram during stop of cooling in Comparative Example 4.

Description will be given as Comparative Example 3 with reference to FIG. 17 about the case in which second three-way valve 12 is switched to the outdoor heat exchanger (condenser) 3 side, first three-way valve 11 remains switched to the outdoor heat exchanger (condenser) 3 side which is the same as during cooling operation, and refrigerant expansion mechanism 4 is closed during stop of cooling. In this case as well, the low-temperature and low-pressure state of indoor heat exchanger (evaporator) 5 can be maintained. However, the high-temperature and high-pressure liquid refrigerant and the refrigerant gas in outdoor heat exchanger (condenser) 3 flow into compressor 1. Particularly in the case of a room air conditioner, a high-pressure shell-type compressor is generally often used as compressor 1, and compressor 1 is gradually cooled to the outdoor air temperature when compressor 1 is stopped. At this time, the temperature of a lubricating oil in the compressor also decreases. As the oil temperature becomes lower, an amount of refrigerant dissolved in the oil becomes larger, and thus, a part of the refrigerant stored in outdoor heat exchanger (condenser) 3 flows into compressor 1. Therefore, a loss of the consumed power and the startup time at the restart of compressor 1 occurs.

Figure 18:
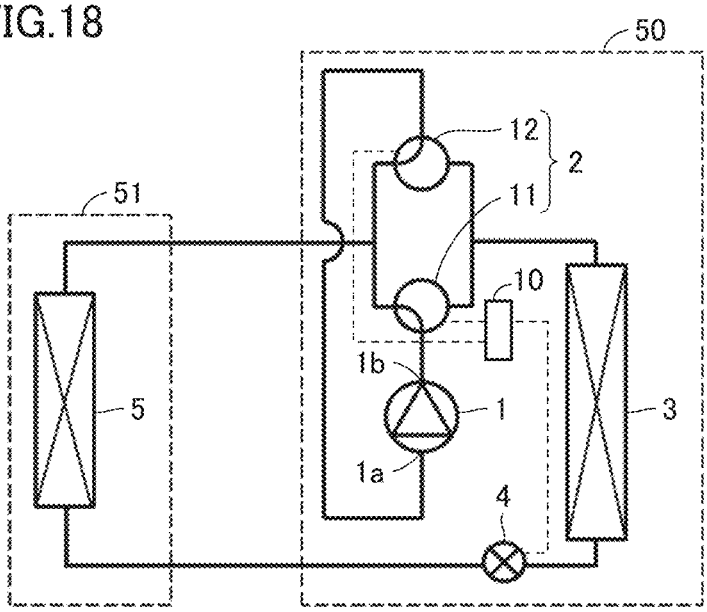
FIG. 18 is a refrigerant circuit diagram during stop of heating in Comparative Example 4.

Description will be given as Comparative Example 4 with reference to FIG. 18 about the case in which second three-way valve 12 is switched to the indoor heat exchanger (condenser) 5 side, first three-way valve 11 remains switched to the indoor heat exchanger (condenser) 5 side which is the same as during heating operation, and refrigerant expansion mechanism 4 is closed during stop of heating. In this case as well, the low-temperature and low-pressure state of outdoor heat exchanger (evaporator) 3 can be maintained. However, the high-temperature and high-pressure liquid refrigerant and the refrigerant gas in indoor heat exchanger (condenser) 5 flow into compressor 1. Therefore, a loss of the consumed power and the startup time at the restart of compressor 1 occurs.

In contrast to these examples, according to the refrigeration cycle apparatus in the present embodiment, refrigerant expansion mechanism 4 closes the refrigerant circuit during stop of compressor 1, and thus, it is possible to prevent the high-temperature and high-pressure liquid refrigerant in the condenser (cooling operation: outdoor heat exchanger 3, heating operation: indoor heat exchanger 5) from flowing into the evaporator (cooling operation: indoor heat exchanger 5, heating operation: outdoor heat exchanger 3). First three-way valve 11 connects outlet 1*b* of compressor 1 to the evaporator (cooling operation: indoor heat exchanger 5, heating operation: outdoor heat exchanger 3), and second three-way valve 12 connects inlet 1*a* of compressor 1 to the evaporator (cooling operation: indoor heat exchanger 5, heating operation: outdoor heat exchanger 3). Therefore, it is possible to prevent the high-temperature and high-pressure liquid refrigerant and the refrigerant gas in the condenser (cooling operation: outdoor heat exchanger 3, heating operation: indoor heat exchanger 5) from flowing into compressor 1. Therefore, the high-temperature and high-pressure liquid refrigerant in the condenser (cooling operation: outdoor heat exchanger 3, heating operation: indoor heat exchanger 5) can be stored between refrigerant expansion mechanism 4 and cooling-heating switching mechanism 2 with the condenser (cooling operation: outdoor heat exchanger 3, heating operation: indoor heat exchanger 5) being interposed. Since the high-temperature and high-pressure refrigerant is enclosed in the condenser (cooling operation: outdoor heat exchanger 3, heating operation: indoor heat exchanger 5) as described above, a pressure difference between the indoor unit and the outdoor unit as well as a distribution of the amount of refrigerant can be maintained. Thus, equalization of the high pressure and the low pressure of the refrigerant during stop of compressor 1 can be prevented. Therefore, it is unnecessary to move the liquid refrigerant flowing from the condenser (cooling operation: outdoor heat exchanger 3, heating operation: indoor heat exchanger 5) into the evaporator (cooling operation: indoor heat exchanger 5, heating operation: outdoor heat exchanger 3) and compressor 1 during stop of compressor 1, from the evaporator (cooling operation: indoor heat exchanger 5, heating operation: outdoor heat exchanger 3) and compressor 1 to the condenser (cooling operation: outdoor heat exchanger 3, heating operation: indoor heat exchanger 5) at the restart of compressor 1. Therefore, the cooling and heating restart time can be reduced and the consumed power in compressor 1 can be reduced. That is, the time required to re-form the high pressure and the low pressure of the refrigerant is unnecessary, and thus, the startup time of the cooling and heating capacity can be reduced. Therefore, the time required to blow out the cold air from indoor unit 51 during cooling and the hot air from indoor unit 51 during heating becomes shorter. In addition, an input of compressor 1 can be reduced. In addition, first three-way valve 11 and second three-way valve 12 can prevent the liquid refrigerant from flowing from the condenser (cooling operation: outdoor heat exchanger 3, heating operation: indoor heat exchanger 5) into compressor 1, and thus, a pressure loss during normal operation can be suppressed as compared with the case of using the check valve in the compressor discharge pipe.

Figure 8:
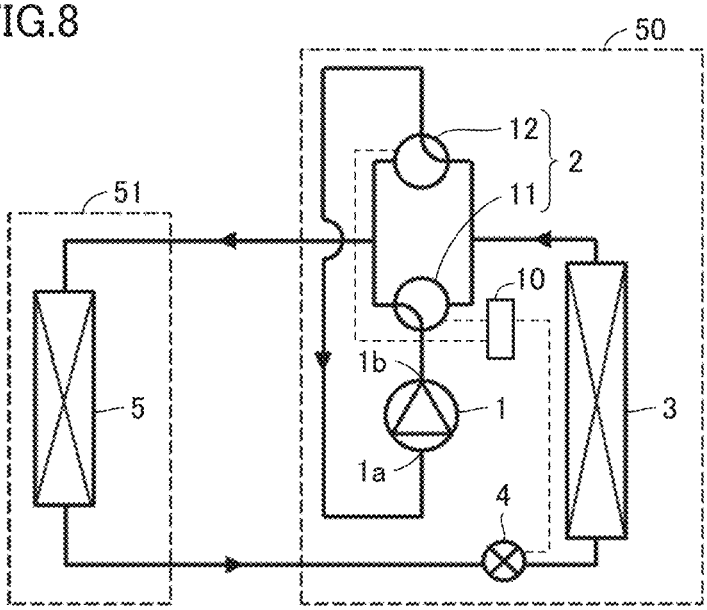
FIG. 8 is a refrigerant circuit diagram during heating operation in the first embodiment of the present invention.

In addition, as shown in FIGS. 1 and 8, during cooling operation and during heating operation, the high-temperature and high-pressure refrigerant discharged from compressor 1 passes through first three-way valve 11, and the low-temperature and low-pressure refrigerant introduced into compressor 1 passes through second three-way valve 12, and thus, the high-temperature fluid and the low-temperature fluid do not flow in proximity to each other in cooling-heating switching mechanism 2. Therefore, a cooling capacity loss caused by internal heat exchange can be reduced as compared with the sliding four-way valve which is a common cooling-heating switching mechanism as in Comparative Example 2.

Figure 2:
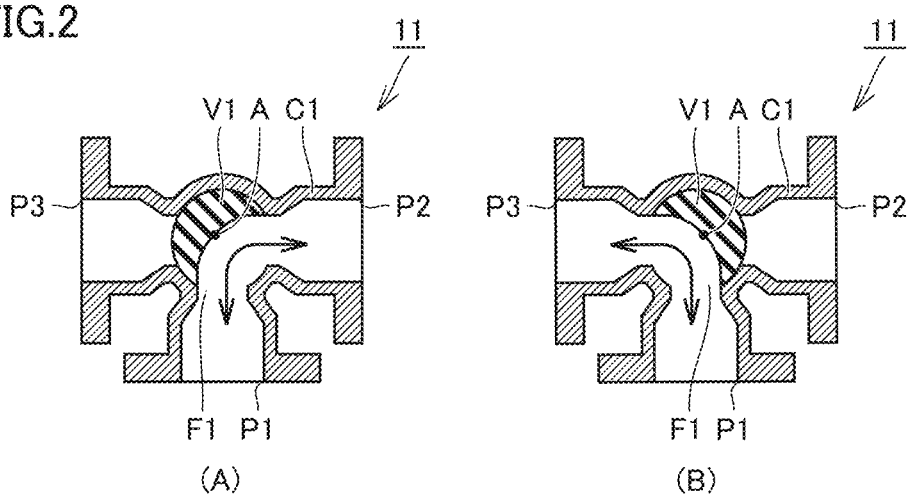
FIG. 2 is a cross-sectional view schematically showing a configuration of one example of a first three-way valve in the first embodiment of the present invention.
Figure 3:
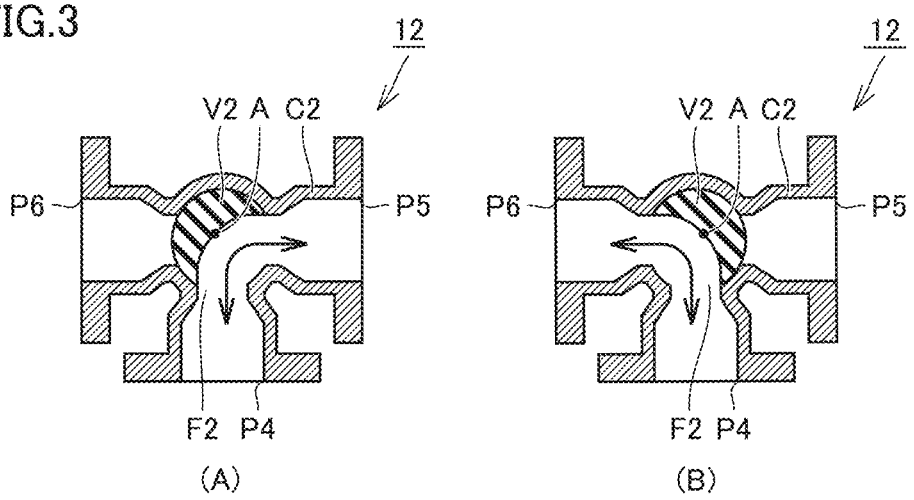
FIG. 3 is a cross-sectional view schematically showing a configuration of one example of a second three-way valve in the first embodiment of the present invention.
Figure 4:
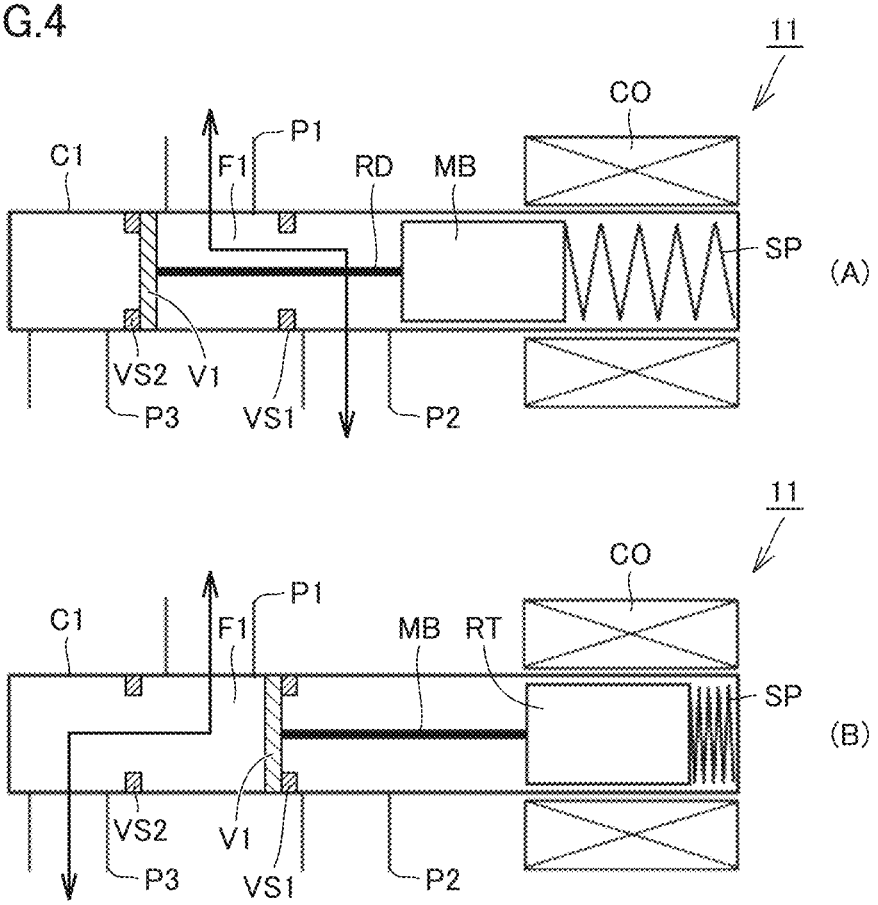
FIG. 4 is a cross-sectional view schematically showing a configuration of another example of the first three-way valve in the first embodiment of the present invention.
Figure 5:
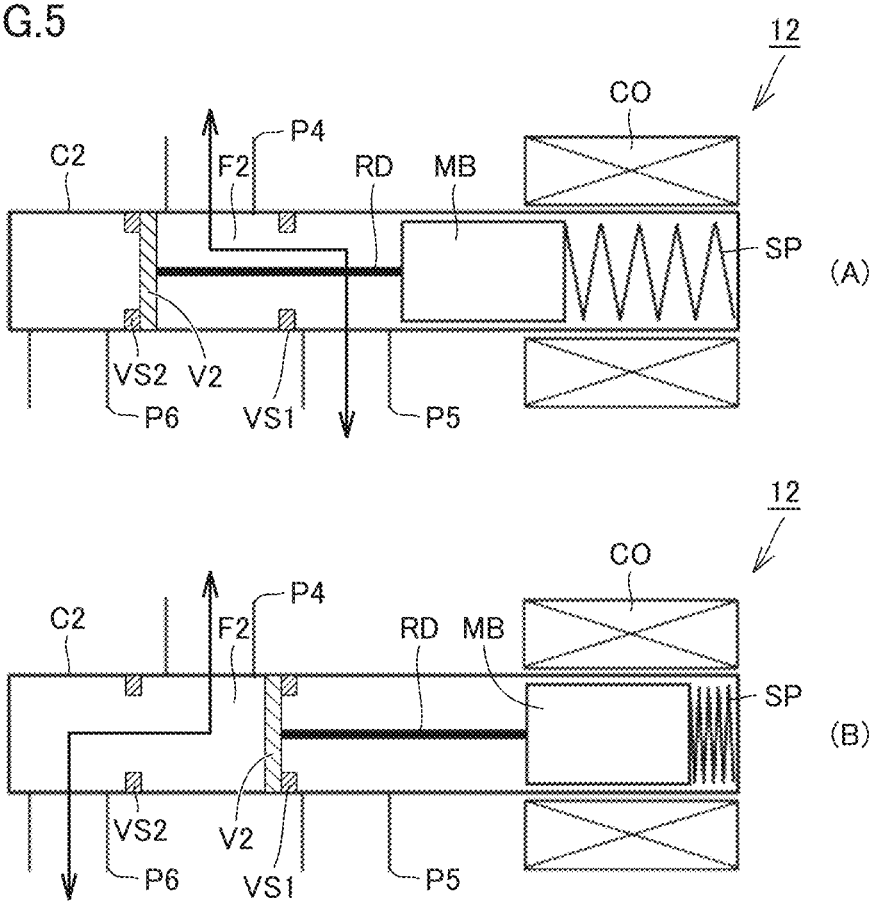
FIG. 5 is a cross-sectional view schematically showing a configuration of another example of the second three-way valve in the first embodiment of the present invention.

In addition, regardless of whether the three-way valve is of valve body type in FIGS. 2 and 3 or of valve seat type in FIGS. 4 and 5, the three-way valve is structurally high in adhesion between the valve body and the valve seat. Therefore, the airtightness with respect to an internal high-low pressure difference is high as compared with the sliding four-way valve which is a common cooling-heating switching mechanism as in Comparative Example 2. Therefore, a cooling capacity loss caused by internal leakage of the refrigerant can be reduced.

In addition, the three-way valve in FIGS. 2 and 3 and the three-way valve in FIGS. 4 and 5 are higher in airtightness than the check valve in Comparative Example 1 and the sliding four-way valve in Comparative Example 2, and thus, an amount of refrigerant leaking inside until restart can be reduced. Therefore, a loss of heat and power related to restart can be reduced.

In addition, according to the refrigeration cycle apparatus in the present embodiment, the first three-way valve switches to connect the first connection port to one of the second connection port and the third connection port by the first valve body. The second three-way valve switches to connect the fourth connection port to one of the fifth connection port and the sixth connection port by the second valve body.

In addition, according to the refrigeration cycle apparatus in the present embodiment, refrigerant expansion mechanism 4 includes the electronic expansion valve. Therefore, the refrigerant circuit can be opened and closed by the electronic expansion valve with a high degree of precision.

In addition, according to the refrigeration cycle apparatus in the present embodiment, refrigerant expansion mechanism 4 includes throttle device 4*a* and shutoff valve 4*b*. Therefore, the refrigerant circuit can be reliably closed by shutoff valve 4*b*. In addition, the time required to reach the fully closed state can be reduced. Furthermore, a capillary tube that does not have a closing mechanism can, for example, be used as throttle device 4*a*.

Second Embodiment

Next, a refrigeration cycle apparatus in a second embodiment of the present invention will be described. In the following description, unless otherwise described, the same reference characters are assigned to the components identical to those of the first embodiment and description will not be repeated.

Figure 19:
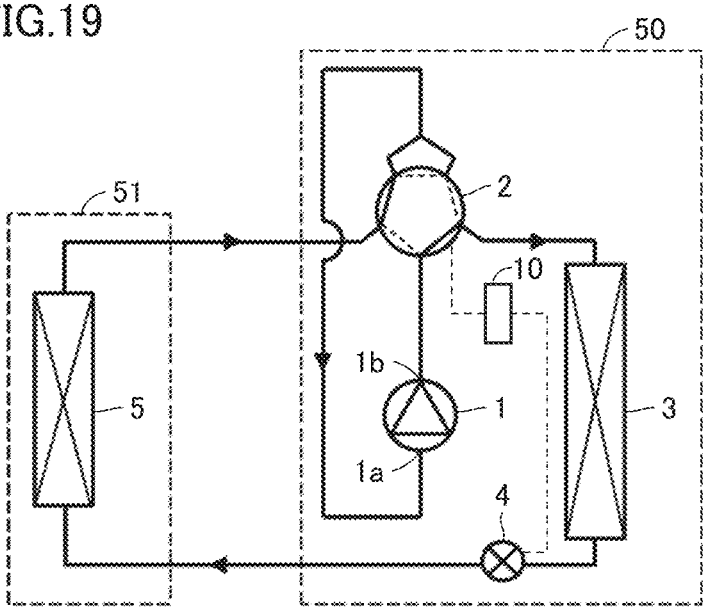
FIG. 19 is a refrigerant circuit diagram of a refrigeration cycle apparatus in a second embodiment of the present invention.

FIG. 19 is a refrigerant circuit diagram of the refrigeration cycle apparatus in the second embodiment of the present invention. Referring to FIG. 19, in the present embodiment, cooling-heating switching mechanism 2 includes a five-way valve. The five-way valve is configured to switch to connect outlet 1*b* of compressor 1 to one of the condenser (cooling operation: outdoor heat exchanger 3, heating operation: indoor heat exchanger 5) and the evaporator (cooling operation: indoor heat exchanger 5, heating operation: outdoor heat exchanger 3). The five-way valve is also configured to switch to connect inlet 1*a* of compressor 1 to one of the condenser (cooling operation: outdoor heat exchanger 3, heating operation: indoor heat exchanger 5) and the evaporator (cooling operation: indoor heat exchanger 5, heating operation: outdoor heat exchanger 3). In addition, the five-way valve is configured to open and close the refrigerant circuit connected to one of outlet 1*b* and inlet 1*a* of compressor 1. In the present embodiment, the five-way valve is configured to open and close the refrigerant circuit connected to inlet 1*a* of compressor 1.

During operation of compressor 1, the five-way valve is configured to connect outlet 1*b* of compressor 1 to the condenser (cooling operation: outdoor heat exchanger 3, heating operation: indoor heat exchanger 5), and is configured to connect inlet 1*a* of compressor 1 to the evaporator (cooling operation: indoor heat exchanger 5, heating operation: outdoor heat exchanger 3). During stop of compressor 1, the five-way valve is configured to connect one of outlet 1*b* and inlet 1*a* of compressor 1 to the evaporator (cooling operation: indoor heat exchanger 5, heating operation: outdoor heat exchanger 3), and is configured to close the refrigerant circuit connected to the other of outlet 1*b* and inlet 1*a* of compressor 1. In the present embodiment, the five-way valve is configured to close the refrigerant circuit connected to inlet 1*a* of compressor 1.

In addition, refrigerant expansion mechanism 4 is configured to open the refrigerant circuit during operation of compressor 1 and close the refrigerant circuit during stop of compressor 1.

The five-way valve has five connection ports. Two of these five connection ports are connected to the compressor suction pipe, and the remaining three connection ports are connected to the compressor discharge pipe, outdoor heat exchanger 3 and indoor heat exchanger 5, respectively. The refrigerant flows similarly from either of the two connection ports connected to the compressor suction pipe.

Figure 20:
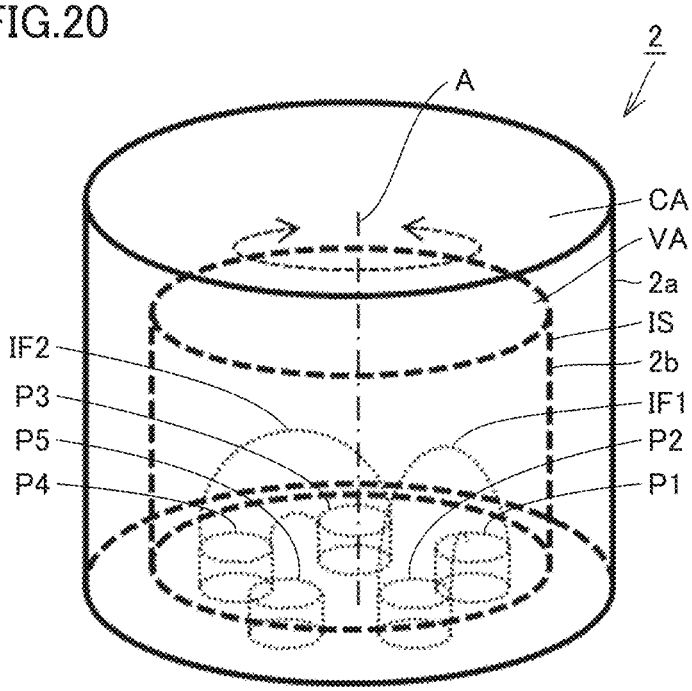
FIG. 20 is a perspective view schematically showing a configuration of a five-way valve in the second embodiment of the present invention.
Figure 21:
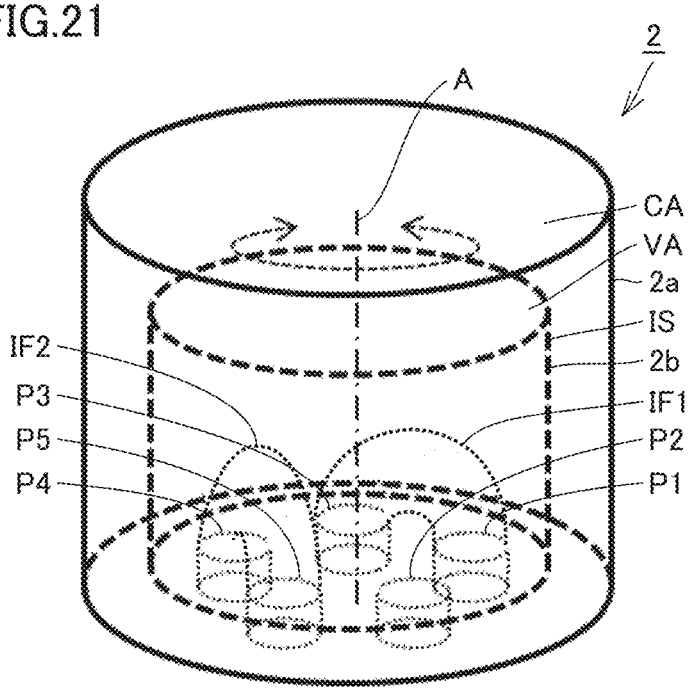
FIG. 21 is a perspective view showing a state in which the five-way valve shown in FIG. 20 has rotated and a first internal flow path and a second internal flow path have been switched.

Referring to FIGS. 20 and 21, the five-way valve in the present embodiment is a rotary five-way valve. The five-way valve includes a case CA and a valve VA. Case CA has a circular internal space IS, and first connection port P1, second connection port P2, third connection port P3, fourth connection port P4, and fifth connection port P5 communicating with internal space IS. Each of first connection port P1, second connection port P2, third connection port P3, fourth connection port P4, and fifth connection port P5 is provided in a bottom surface of case CA.

Valve VA is arranged in internal space IS of case CA. Valve VA has a cylindrical shape. Valve VA is configured to be rotatable about axial direction A. Valve VA has a first internal flow path IF1 and a second internal flow path IF2. First internal flow path IF1 is configured to allow two of first connection port P1, second connection port P2, third connection port P3, fourth connection port P4, and fifth connection port P5 to communicate with each other. Second internal flow path IF2 is configured to allow the other two connection ports to communicate with each other. Each of first internal flow path IF1 and second internal flow path IF2 is configured to extend from the bottom surface toward a top surface of valve VA and then be folded back to the bottom surface.

Valve VA is configured to rotate about the axial direction, thereby switching to allow two of first connection port P1, second connection port P2, third connection port P3, fourth connection port P4, and fifth connection port P5 to selectively communicate with each other by each of first internal flow path IF1 and second internal flow path IF2, and close the remaining one connection port.

Referring to FIGS. 19 and 20, first connection port P1 is connected to outlet 1*b* of compressor 1. Second connection port P2 is connected to one of the condenser (cooling operation: outdoor heat exchanger 3, heating operation: indoor heat exchanger 5) and the evaporator (cooling operation: indoor heat exchanger 5, heating operation: outdoor heat exchanger 3). Third connection port P3 is connected to the other of the condenser (cooling operation: outdoor heat exchanger 3, heating operation: indoor heat exchanger 5) and the evaporator (cooling operation: indoor heat exchanger 5, heating operation: outdoor heat exchanger 3). Fourth connection port P4 and fifth connection port P5 are connected to inlet 1*a* of compressor 1.

Next, the operation of the refrigeration cycle apparatus in the present embodiment will be described.

The operation during cooling operation will be described with reference again to FIG. 19. During cooling operation, the five-way valve is switched as shown in FIG. 19, and thus, the compressor discharge pipe and outdoor heat exchanger (condenser) 3 are connected and the compressor suction pipe and indoor heat exchanger (evaporator) 5 are connected.

Specifically, during operation of compressor 1, the five-way valve connects outlet 1*b* of compressor 1 to outdoor heat exchanger (condenser) 3 and connects inlet 1*a* of compressor 1 to indoor heat exchanger (evaporator) 5. Furthermore, refrigerant expansion mechanism 4 is opened. That is, refrigerant expansion mechanism 4 operates so as to open the refrigerant circuit.

The refrigerant flows through compressor 1 and cooling-heating switching mechanism 2, is condensed in outdoor heat exchanger (condenser) 3, is expanded in refrigerant expansion mechanism 4 to come into a low-pressure two-phase state, is evaporated in indoor heat exchanger (evaporator) 5, and flows through cooling-heating switching mechanism 2 to compressor 1 again. In this way, the refrigerant circulates through the refrigeration cycle apparatus.

Figure 22:
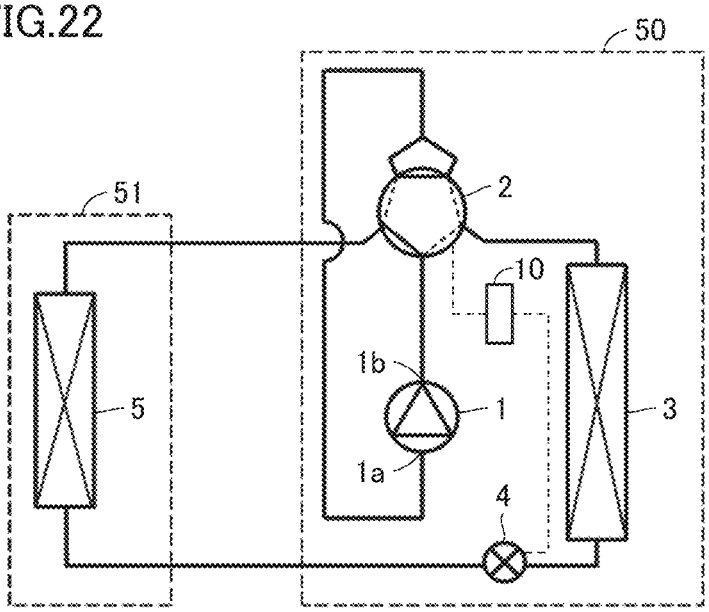
FIG. 22 is a refrigerant circuit diagram during stop of cooling in the second embodiment of the present invention.

Next, the operation during stop of cooling will be described with reference to FIG. 22. During stop of cooling, the five-way valve is switched as shown in FIG. 22, and thus, the compressor discharge pipe and indoor heat exchanger (evaporator) 5 are connected and the compressor suction pipes are connected. At the same time, refrigerant expansion mechanism 4 is closed.

Specifically, during stop of compressor 1, the five-way valve connects outlet 1*b* of compressor 1 to indoor heat exchanger (evaporator) 5 and closes the refrigerant circuit connected to inlet 1*a* of compressor 1. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with outdoor heat exchanger (condenser) 3 being interposed. As a result, the high-temperature and high-pressure liquid refrigerant in outdoor heat exchanger (condenser) 3 is stored between refrigerant expansion mechanism 4 and cooling-heating switching mechanism 2.

Figure 23:
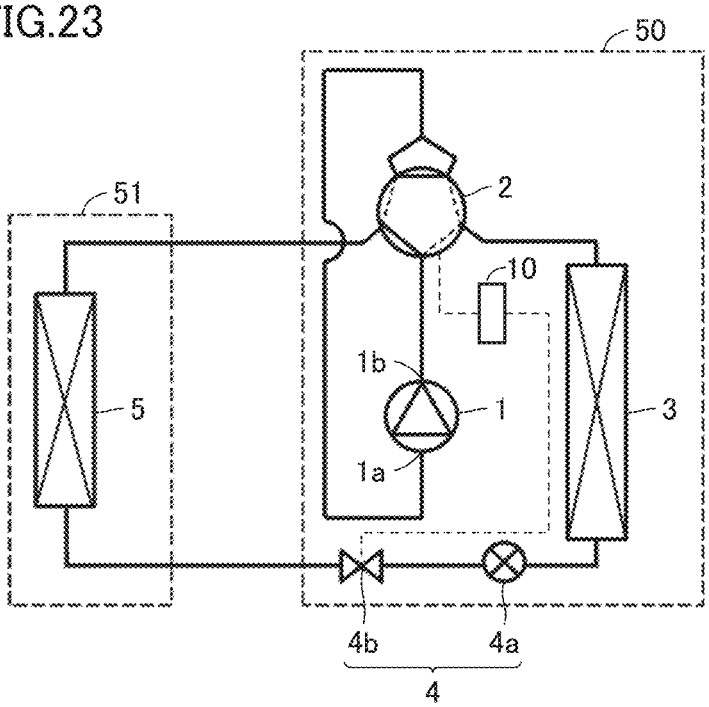
FIG. 23 is a refrigerant circuit diagram of a modification of a refrigerant expansion mechanism during stop of cooling in the second embodiment of the present invention.

Next, a modification of refrigerant expansion mechanism 4 during stop of cooling will be described with reference to FIG. 23. Similarly to the first embodiment, in the present embodiment as well, refrigerant expansion mechanism 4 includes throttle device 4*a* and shutoff valve 4*b* in the modification of refrigerant expansion mechanism 4 during stop of cooling.

Figure 24:
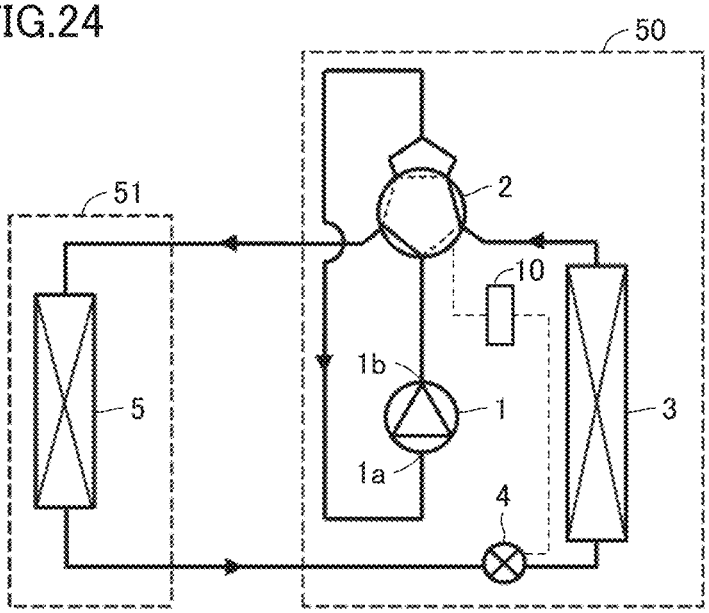
FIG. 24 is a refrigerant circuit diagram during heating operation in the second embodiment of the present invention.

Next, the operation during heating operation will be described with reference to FIG. 24. During heating operation, the five-way valve is switched as shown in FIG. 24, and thus, the compressor discharge pipe and indoor heat exchanger (condenser) 5 are connected and the compressor suction pipe and outdoor heat exchanger (evaporator) 3 are connected.

Specifically, during operation of compressor 1, the five-way valve connects outlet 1*b* of compressor 1 to indoor heat exchanger (condenser) 5 and connects inlet 1*a* of compressor 1 to outdoor heat exchanger (evaporator) 3. Furthermore, refrigerant expansion mechanism 4 is opened. That is, refrigerant expansion mechanism 4 operates so as to open the refrigerant circuit.

The refrigerant flows through compressor 1 and cooling-heating switching mechanism 2, is condensed in indoor heat exchanger (condenser) 5, is expanded in refrigerant expansion mechanism 4 to come into a low-pressure two-phase state, is evaporated in outdoor heat exchanger (evaporator) 3, and flows through cooling-heating switching mechanism 2 to compressor 1 again. In this way, the refrigerant circulates through the refrigeration cycle apparatus.

Figure 25:
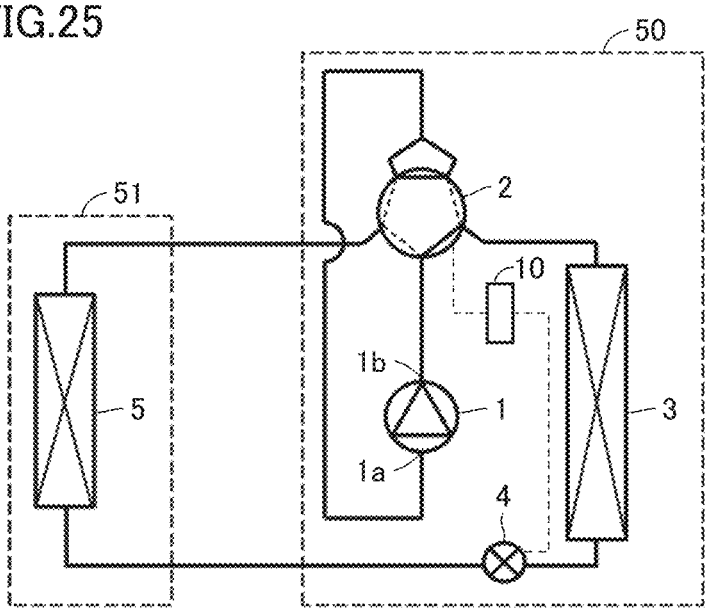
FIG. 25 is a refrigerant circuit diagram during stop of heating in the second embodiment of the present invention.

Next, the operation during stop of heating will be described with reference to FIG. 25. During stop of heating, the five-way valve is switched as shown in FIG. 25, and thus, the compressor discharge pipe and outdoor heat exchanger (evaporator) 3 are connected and the compressor suction pipes are connected. At the same time, refrigerant expansion mechanism 4 is closed.

Specifically, during stop of compressor 1, the five-way valve connects outlet 1*b* of compressor 1 to outdoor heat exchanger (evaporator) 3 and closes the refrigerant circuit connected to inlet 1*a* of compressor 1. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with indoor heat exchanger (condenser) 5 being interposed. As a result, the high-temperature and high-pressure liquid refrigerant in indoor heat exchanger (condenser) 5 is stored between refrigerant expansion mechanism 4 and cooling-heating switching mechanism 2.

Figure 26:
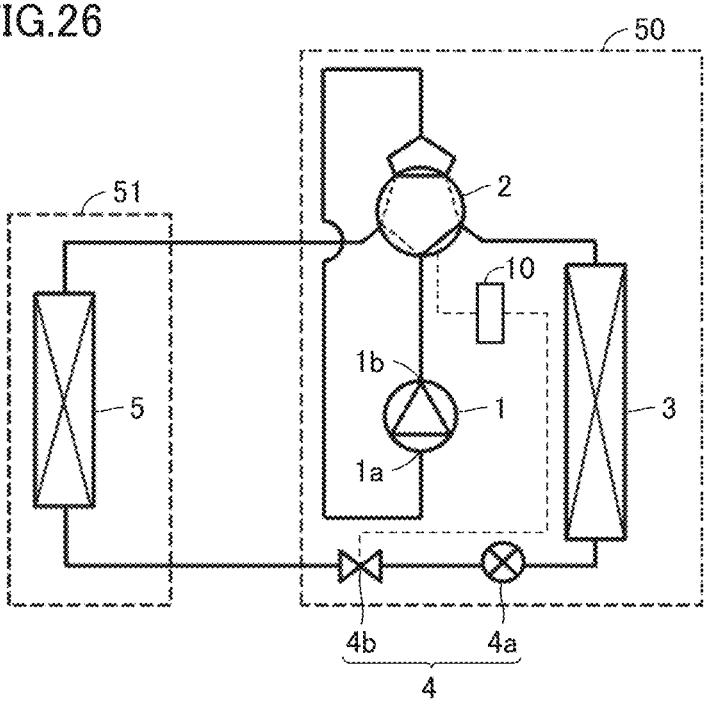
FIG. 26 is a refrigerant circuit diagram of the modification of the refrigerant expansion mechanism during stop of heating in the second embodiment of the present invention.

Next, a modification of refrigerant expansion mechanism 4 during stop of heating will be described with reference to FIG. 26. Similarly to the first embodiment, in the present embodiment as well, refrigerant expansion mechanism 4 includes throttle device 4*a* and shutoff valve 4*b* in the modification of refrigerant expansion mechanism 4 during stop of heating.

Next, the function and effect of the refrigeration cycle apparatus in the present embodiment will be described.

According to the refrigeration cycle apparatus in the present embodiment, refrigerant expansion mechanism 4 closes the refrigerant circuit during stop of compressor 1, and thus, it is possible to prevent the high-temperature and high-pressure liquid refrigerant in the condenser (cooling operation: outdoor heat exchanger 3, heating operation: indoor heat exchanger 5) from flowing into the evaporator (cooling operation: indoor heat exchanger 5, heating operation: outdoor heat exchanger 3). The five-way valve connects one of outlet 1*b* and inlet 1*a* of compressor 1 to the evaporator (cooling operation: indoor heat exchanger 5, heating operation: outdoor heat exchanger 3), and closes the refrigerant circuit connected to the other of outlet 1*b* and inlet 1*a* of compressor 1. Therefore, it is possible to prevent the high-temperature and high-pressure liquid refrigerant and the refrigerant gas in the condenser (cooling operation: outdoor heat exchanger 3, heating operation: indoor heat exchanger 5) from flowing into compressor 1. Therefore, the high-temperature and high-pressure liquid refrigerant in the condenser (cooling operation: outdoor heat exchanger 3, heating operation: indoor heat exchanger 5) can be stored between refrigerant expansion mechanism 4 and cooling-heating switching mechanism 2 with the condenser (cooling operation: outdoor heat exchanger 3, heating operation: indoor heat exchanger 5) being interposed. As a result, the cooling and heating restart time can be reduced and the consumed power in compressor 1 can be reduced. In addition, the five-way valve can prevent the liquid refrigerant from flowing from the condenser (cooling operation: outdoor heat exchanger 3, heating operation: indoor heat exchanger 5) into compressor 1, and thus, a pressure loss during normal operation can be suppressed as compared with the case of using the check valve in the compressor discharge pipe.

In addition, the rotary valve is higher in airtightness than the above-described check valve and the above-described sliding four-way valve. Therefore, both during operation of the compressor and during stop of the compressor, a cooling and heating capacity loss caused by internal leakage of the refrigerant and a cooling and heating restart loss can be reduced.

In addition, according to the refrigeration cycle apparatus in the present embodiment, fourth connection port P4 and fifth connection port P5 are connected to inlet 1*a* of compressor 1. Therefore, the refrigerant circuit can be closed by connecting fourth connection port P4 and fifth connection port P5.

Third Embodiment

Next, a refrigeration cycle apparatus in a third embodiment of the present invention will be described. In the following description, unless otherwise described, the same reference characters are assigned to the components identical to those of the first and second embodiments and description will not be repeated.

Figure 27:
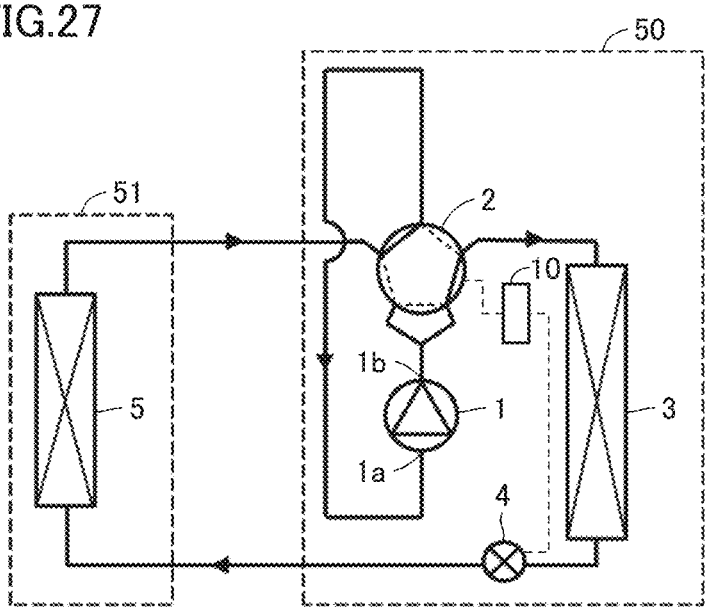
FIG. 27 is a refrigerant circuit diagram of a refrigeration cycle apparatus in a third embodiment of the present invention.

FIG. 27 is a refrigerant circuit diagram of the refrigeration cycle apparatus in the third embodiment of the present invention. In the present embodiment, the five-way valve is configured to open and close the refrigerant circuit connected to outlet 1*b* of compressor 1.

Two of the five connection ports of the five-way valve are connected to the compressor discharge pipe, and the remaining three connection ports are connected to the compressor suction pipe, outdoor heat exchanger 3 and indoor heat exchanger 5, respectively. The refrigerant similarly flows from either of the two connection ports connected to the compressor discharge pipe.

Referring to FIGS. 20 and 27, first connection port P1 and second connection port P2 are connected to outlet 1*b* of compressor 1. Third connection port P3 is connected to inlet 1*a* of compressor 1. Fourth connection port P4 is connected to one of the condenser (cooling operation: outdoor heat exchanger 3, heating operation: indoor heat exchanger 5) and the evaporator (cooling operation: indoor heat exchanger 5, heating operation: outdoor heat exchanger 3). Fifth connection port P5 is connected to the other of the condenser (cooling operation: outdoor heat exchanger 3, heating operation: indoor heat exchanger 5) and the evaporator (cooling operation: indoor heat exchanger 5, heating operation: outdoor heat exchanger 3).

Next, the operation of the refrigeration cycle apparatus in the present embodiment will be described.

The operation during cooling operation will be described with reference again to FIG. 27. During cooling operation, the five-way valve is switched as shown in FIG. 27, and thus, the compressor discharge pipe and outdoor heat exchanger (condenser) 3 are connected and the compressor suction pipe and indoor heat exchanger (evaporator) 5 are connected.

Specifically, during operation of compressor 1, the five-way valve connects outlet 1*b* of compressor 1 to outdoor heat exchanger (condenser) 3 and connects inlet 1*a* of compressor 1 to indoor heat exchanger (evaporator) 5. Furthermore, refrigerant expansion mechanism 4 is opened. That is, refrigerant expansion mechanism 4 operates so as to open the refrigerant circuit.

The refrigerant flows through compressor 1 and cooling-heating switching mechanism 2, is condensed in outdoor heat exchanger (condenser) 3, is expanded in refrigerant expansion mechanism 4 to come into a low-pressure two-phase state, is evaporated in indoor heat exchanger (evaporator) 5, and flows through cooling-heating switching mechanism 2 to compressor 1 again. In this way, the refrigerant circulates through the refrigeration cycle apparatus.

Figure 28:
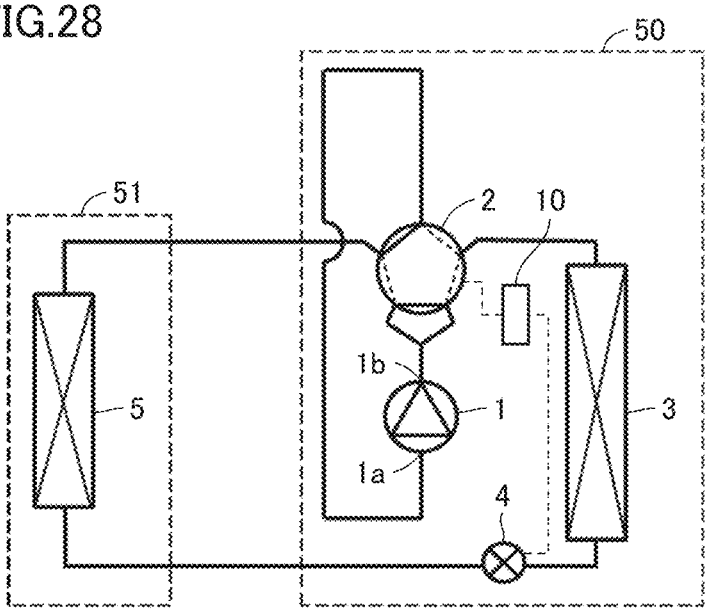
FIG. 28 is a refrigerant circuit diagram during stop of cooling in the third embodiment of the present invention.

Next, the operation during stop of cooling will be described with reference to FIG. 28. During stop of cooling, the five-way valve is switched as shown in FIG. 28, and thus, the compressor suction pipe and indoor heat exchanger (evaporator) 5 are connected and the compressor discharge pipes are connected. At the same time, refrigerant expansion mechanism 4 is closed.

Specifically, during stop of compressor 1, the five-way valve connects inlet 1*a* of compressor 1 to indoor heat exchanger (evaporator) 5 and closes the refrigerant circuit connected to outlet 1*b* of compressor 1. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with outdoor heat exchanger (condenser) 3 being interposed. As a result, the high-temperature and high-pressure liquid refrigerant in outdoor heat exchanger (condenser) 3 is stored between refrigerant expansion mechanism 4 and cooling-heating switching mechanism 2.

Figure 29:
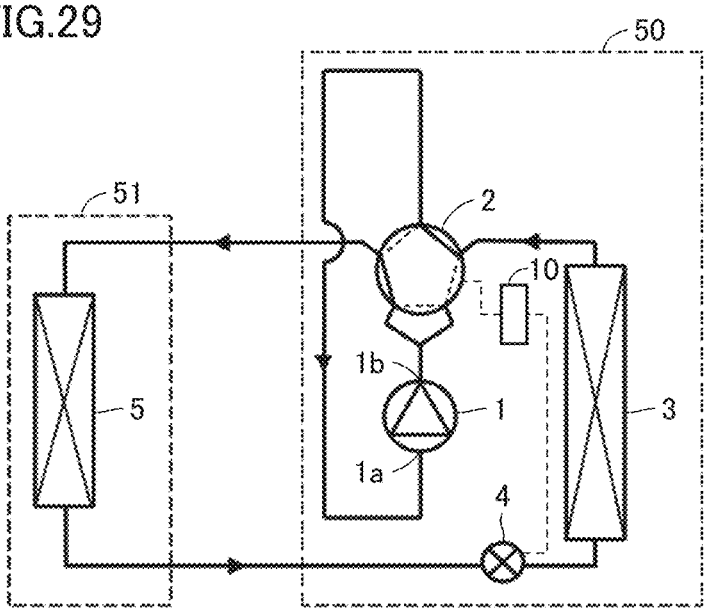
FIG. 29 is a refrigerant circuit diagram during heating operation in the third embodiment of the present invention.

Next, the operation during heating operation will be described with reference to FIG. 29. During heating operation, the five-way valve is switched as shown in FIG. 29, and thus, the compressor discharge pipe and indoor heat exchanger (condenser) 5 are connected and the compressor suction pipe and outdoor heat exchanger (evaporator) 3 are connected.

Specifically, during operation of compressor 1, the five-way valve connects outlet 1*b* of compressor 1 to indoor heat exchanger (condenser) 5 and connects inlet 1*a* of compressor 1 to outdoor heat exchanger (evaporator) 3. Furthermore, refrigerant expansion mechanism 4 is opened. That is, refrigerant expansion mechanism 4 operates so as to open the refrigerant circuit.

The refrigerant flows through compressor 1 and cooling-heating switching mechanism 2, is condensed in indoor heat exchanger (condenser) 5, is expanded in refrigerant expansion mechanism 4 to come into a low-pressure two-phase state, is evaporated in outdoor heat exchanger (evaporator) 3, and flows through cooling-heating switching mechanism 2 to compressor 1 again. In this way, the refrigerant circulates through the refrigeration cycle apparatus.

Figure 30:
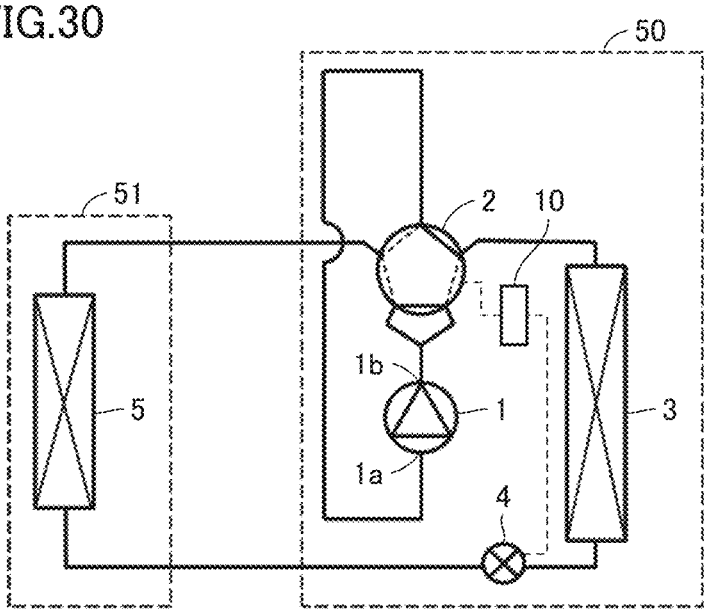
FIG. 30 is a refrigerant circuit diagram during stop of heating in the third embodiment of the present invention.

Next, the operation during stop of heating will be described with reference to FIG. 30. During stop of heating, the five-way valve is switched as shown in FIG. 30, and thus, the compressor suction pipe and outdoor heat exchanger (evaporator) 3 are connected and the compressor discharge pipes are connected. At the same time, refrigerant expansion mechanism 4 is closed.

Specifically, during stop of compressor 1, the five-way valve connects inlet 1*a* of compressor 1 to outdoor heat exchanger (evaporator) 3 and closes the refrigerant circuit connected to outlet 1*b* of compressor 1. Furthermore, refrigerant expansion mechanism 4 is closed. That is, refrigerant expansion mechanism 4 operates so as to close the refrigerant circuit.

Therefore, the refrigerant is enclosed between cooling-heating switching mechanism 2 and refrigerant expansion mechanism 4 with indoor heat exchanger (condenser) 5 being interposed. As a result, the high-temperature and high-pressure liquid refrigerant in indoor heat exchanger (condenser) 5 is stored between refrigerant expansion mechanism 4 and cooling-heating switching mechanism 2.

According to the refrigeration cycle apparatus in the present embodiment, the five-way valve is switched as described above during stop of cooling and during stop of heating, and thus, the high-temperature and high-pressure liquid refrigerant can be enclosed in the heat exchanger on the condenser side during stop of the compressor. As a result, equalization of the high pressure and the low pressure during stop of the compressor can be prevented, and thus, the restart power of the compressor can be reduced. In addition, the time required to re-form the high pressure and the low pressure is unnecessary, and thus, the startup time of the cooling and heating capacity can be reduced.

As to the connection pipes of the five-way valve, the compressor suction pipe occupies the two connection ports in the second embodiment, while the compressor discharge pipe occupies the two connection ports in the third embodiment. Since the density of the refrigerant is lower in the case of the low pressure than in the case of the high pressure, a pressure loss increases unless a pipe diameter is large. Therefore, the compressor discharge pipe is connected to the two connection ports in the third embodiment, and thus, the five-way valve can be reduced in size.

In addition, according to the refrigeration cycle apparatus in the present embodiment, first connection port P1 and second connection port P2 are connected to outlet 1*b* of compressor 1. Therefore, the refrigerant circuit can be closed by connecting fourth connection port P4 and fifth connection port P5.

The above-described embodiments can be combined as appropriate.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A refrigeration cycle apparatus comprising:

a refrigerant circuit having a compressor, a cooling-heating switching mechanism, a condenser, a refrigerant expansion mechanism, and an evaporator; and refrigerant circulating through the refrigerant circuit in order of the compressor, the cooling-heating switching mechanism, the condenser, the refrigerant expansion mechanism, the evaporator, and the cooling-heating switching mechanism, the compressor having an inlet and an outlet, the refrigerant expansion mechanism being configured to open and close the refrigerant circuit, the cooling-heating switching mechanism having a multi-way valve, the multi-way valve being configured to switch to connect the outlet of the compressor to one of the condenser and the evaporator, switch to connect the inlet of the compressor to one of the condenser and the evaporator, and open and close the refrigerant circuit connected to one of the outlet and the inlet of the compressor, during stop of the compressor, the refrigerant expansion mechanism being configured to close the refrigerant circuit, and the multi-way valve being configured to connect one of the outlet and the inlet of the compressor to the evaporator, and being configured to close the refrigerant circuit connected to the other of the outlet and the inlet of the compressor, wherein the multi-way valve comprises a case having a circular internal space, and a first connection port, a second connection port, a third connection port, a fourth connection port, and a fifth connection port communicating with the internal space, and a valve arranged in the internal space of the case and having a first internal flow path and a second internal flow path, the first internal flow path allowing two of the first connection port, the second connection port, the third connection port, the fourth connection port, and the fifth connection port to communicate with each other, the second internal flow path allowing the other two connection ports to communicate with each other, the valve being rotatable about an axial direction, and the valve is configured to rotate about the axial direction, thereby switching to allow two of the first connection port, the second connection port, the third connection port, the fourth connection port, and the fifth connection port to selectively communicate with each other by each of the first internal flow path and the second internal flow path, and close the remaining one connection port.

2. The refrigeration cycle apparatus according to claim 1, wherein the first connection port is connected to the outlet of the compressor, the second connection port is connected to one of the condenser and the evaporator, the third connection port is connected to the other of the condenser and the evaporator, and the fourth connection port and the fifth connection port are connected to the inlet of the compressor.

3. The refrigeration cycle apparatus according to claim 1, wherein the first connection port and the second connection port are connected to the outlet of the compressor, the third connection port is connected to the inlet of the compressor, the fourth connection port is connected to one of the condenser and the evaporator, and the fifth connection port is connected to the other of the condenser and the evaporator.

4. The refrigeration cycle apparatus according to claim 1, wherein the refrigerant expansion mechanism comprises an electronic expansion valve.

5. The refrigeration cycle apparatus according to claim 1, wherein the refrigerant expansion mechanism comprises a throttle device and a shutoff valve connected between the throttle device and the condenser or between the throttle device and the evaporator.

* * * * *